US008280267B2

(12) United States Patent
Kusakabe

(10) Patent No.: US 8,280,267 B2
(45) Date of Patent: Oct. 2, 2012

(54) IMAGE FORMING APPARATUS

(75) Inventor: Yoshiaki Kusakabe, Tokyo (JP)

(73) Assignee: Oki Data Corporation, Tokyo (JP)

( * ) Notice: Subject to any disclaimer, the term of this patent is extended or adjusted under 35 U.S.C. 154(b) by 252 days.

(21) Appl. No.: 12/853,662

(22) Filed: Aug. 10, 2010

(65) Prior Publication Data

US 2011/0044708 A1 Feb. 24, 2011

(30) Foreign Application Priority Data

Aug. 19, 2009 (JP) ..... 2009-189644

(51) Int. Cl.
*G03G 15/00* (2006.01)

(52) U.S. Cl. ..... 399/49; 399/53; 399/299; 399/301; 399/302; 399/308

(58) Field of Classification Search ..... 399/49, 399/53, 299, 301, 302, 308
See application file for complete search history.

(56) References Cited

U.S. PATENT DOCUMENTS 6,061,542 A * 5/2000 Minami et al. ..... 399/299
2009/0035029 A1* 2/2009 Kobayashi ..... 399/298
2009/0263150 A1* 10/2009 Fujimori et al. ..... 399/49

FOREIGN PATENT DOCUMENTS

JP 2004-258281 9/2004

* cited by examiner

*Primary Examiner* — Ryan Walsh
(74) *Attorney, Agent, or Firm* — Kubotera & Associates, LLC

(57) ABSTRACT

An image forming apparatus includes a first image forming unit for forming a first developer image; a second image forming unit for forming a second developer image; a transfer unit for transferring at least one of the first developer image and the second developer image; a separation contacting unit for moving at least one of the first image forming unit and the second image forming unit to a first position and a second position; a density measurement unit for measuring a first image density and a second image density of the first developer image; and a control unit including a density calculation unit for calculating a difference between the first image density and the second image density and a density correction unit for correcting a density of the first developer image according to the difference.

10 Claims, 10 Drawing Sheets

IMAGE FORMING APPARATUS

BACKGROUND OF THE INVENTION AND RELATED ART STATEMENT

The present invention relates to an image forming apparatus. More specifically, the present invention relates to an image forming apparatus capable of forming a color image.

A conventional image forming apparatus includes a printer of an electro-photography type, a facsimile, a copier, and an MFP (a multi function peripheral or product) having three functions of the printer, the facsimile, and the copier. Especially, there is a conventional image forming apparatus capable of forming a color image.

The conventional image forming apparatus capable of forming a color image is provided with a plurality of image forming units corresponding to developer (toner) in a plurality of colors. In the conventional image forming apparatus, a developer image (a toner image) corresponding to each color is formed on a photosensitive drum disposed in each of the image forming units. Then, the developer images are overlapped (transferred) on a transfer medium (a sheet or a transfer belt), thereby forming a color image.

In the conventional image forming apparatus, it is necessary to properly adjust color balance to obtain a color image with high quality. To this end, the conventional image forming apparatus may be configured such that an energy amount of a static latent image forming unit and an energy amount of a developing unit are controlled to adjust a density of each color, thereby adjusting the color balance (Refer to Patent Reference).

Patent Reference: Japanese Patent Publication No. 2004-258281

In the conventional image forming apparatus described above, an energy amount of light to be irradiated on the photosensitive drum is defined as the energy amount of the static latent image forming unit. The energy amount of light is represented with, for example, an exposure time of an exposure unit such as an LED (Light emitting diode) and a laser light source or a drive power of the exposure unit. In the following description, the energy amount of the static latent image forming unit is referred to as an exposure light energy. Further, an energy amount represented with a developing voltage, a supply voltage, a charging voltage, or a combination thereof is defined as the energy amount of the developing unit. In the following description, the energy amount of the developing unit is referred to as a developing energy.

In the conventional image forming apparatus described above, when the color balance is adjusted, first, a density detection test pattern is printed (transferred) on the transfer medium (the transfer belt). A density detection unit (a density sensor) measures a density of the test pattern, so that one of the exposure light energy or the developing energy is controlled according to the density of the test pattern.

In this case, the exposure light energy is controlled through adding a correction value of a light amount to a printing condition. The developing energy is controlled through adding a correction value of the developing voltage to a printing condition. After one of the exposure light energy or the developing energy is controlled, a density detection test pattern with a different density is printed (transferred) on the transfer medium (the transfer belt). Then, the density detection unit (a density sensor) measures a density of the test pattern, so that the other of the exposure light energy or the developing energy is controlled according to the density of the test pattern. Through the process described above, the conventional image forming apparatus adjusts the color balance.

In general, the conventional image forming apparatus is capable of selectively printing a monochrome image and a color image. In the following description, a mode of printing a monochrome image is referred to as a monochrome mode, and a mode of printing a color image is referred to as a color mode. Note that a monochrome image mostly includes an image formed of black developer, and may include an image formed of single developer other than black developer.

In the conventional image forming apparatus, the monochrome mode and the color mode are switched as follows. In the monochrome mode, it is assumed that the monochrome image is formed of black developer.

In order to switch between the monochrome mode and the color mode, the conventional image forming apparatus is provided with an up-down mechanism for selectively lifting or lowering each of the image forming units. The up-down mechanism is provided as a separation contacting mechanism for selectively lifting or lowering each of the image forming units, so that each of the image forming units selectively contacts with or is separated from a transfer unit.

When the conventional image forming apparatus performs a printing operation in the monochrome mode, the up-down mechanism is operated to contact only the image forming unit corresponding to black developer (referred to as a black image forming unit) with the transfer unit, and separate the image forming units corresponding to other colors (referred to as other image forming units) from the transfer unit.

When the conventional image forming apparatus performs the printing operation in the color mode, the up-down mechanism is operated to contact all of the image forming units with the transfer unit. Through the process described above, the conventional image forming apparatus switches between the monochrome mode and the color mode.

When the conventional image forming apparatus performs the printing operation in the monochrome mode and the color mode, an image printed in a color (for example, black) commonly used in the monochrome mode and the color mode may have different densities as described below. The color commonly used in the monochrome mode and the color mode is referred to as a common color.

When the conventional image forming apparatus performs the printing operation in the monochrome mode, only the image forming unit corresponding to the common color (for example, black) contacts with the transfer unit, so that an image in the common color formed on the photosensitive drum is transferred to the transfer medium. When the conventional image forming apparatus performs the printing operation in the color mode, all of the image forming units contact with the transfer unit, so that images in all colors formed on the photosensitive drums are transferred to the transfer medium.

When the image forming units corresponding to the colors other than the common color are arranged on a downstream side of the image forming unit corresponding to the common color, the image in the common color may contact with the image forming units corresponding to the colors other than the common color. In other words, when the conventional image forming apparatus performs the printing operation in the color mode, the image in the common color may contact with the number of the image forming units different from that of the image forming units when the conventional image forming apparatus performs the printing operation in the monochrome mode. As a result, the image in the common color (for example, black) may have different densities in the monochrome mode and the color mode.

In view of the problems described above, an object of the present invention is to provide an image forming apparatus capable of solving the problems of the conventional image forming apparatus. In the present invention, it is possible to form an image in the common color (for example, black) with a same density when the image forming apparatus performs a printing operation in the monochrome mode and the color mode.

Further objects and advantages of the invention will be apparent from the following description of the invention.

SUMMARY OF THE INVENTION

In order to attain the objects described above, according to an aspect of the present invention, an image forming apparatus includes a first image forming unit for forming a first developer image using first developer; a second image forming unit for forming a second developer image using second developer; a transfer unit disposed to contact with at least one of the first image forming unit and the second image forming unit for transferring at least one of the first developer image and the second developer image; a density measurement unit for measuring a density of the first developer image and the second developer image transferred with the transfer unit; a separation contacting unit for moving at least one of the first image forming unit and the second image forming unit to a first position contacting with the transfer unit and to a second position away from the transfer unit; and a control unit for controlling the first image forming unit, the second image forming unit, the density measurement unit, and the separation contacting unit.

According to the aspect of the present invention, the density measurement unit is arranged to measure a first image density of the first developer image when the first image forming unit is situated at the first position and the second image forming unit is situated at the second position. Further, the density measurement unit is arranged to measure a second image density of the first developer image when the first image forming unit and the second image forming unit are situated at the first position.

According to the aspect of the present invention, the control unit includes a density calculation unit for calculating a difference between the first image density and the second image density; and a density correction unit for correcting a density of the first developer image formed with the first image forming unit according to the difference between the first image density and the second image density calculated with the density calculation unit.

In the present invention, it is possible to form an image in the common color (for example, black) with a same density when the image forming apparatus performs a printing operation in the monochrome mode and the color mode.

DETAILED DESCRIPTION OF PREFERRED EMBODIMENTS

Figure 1:
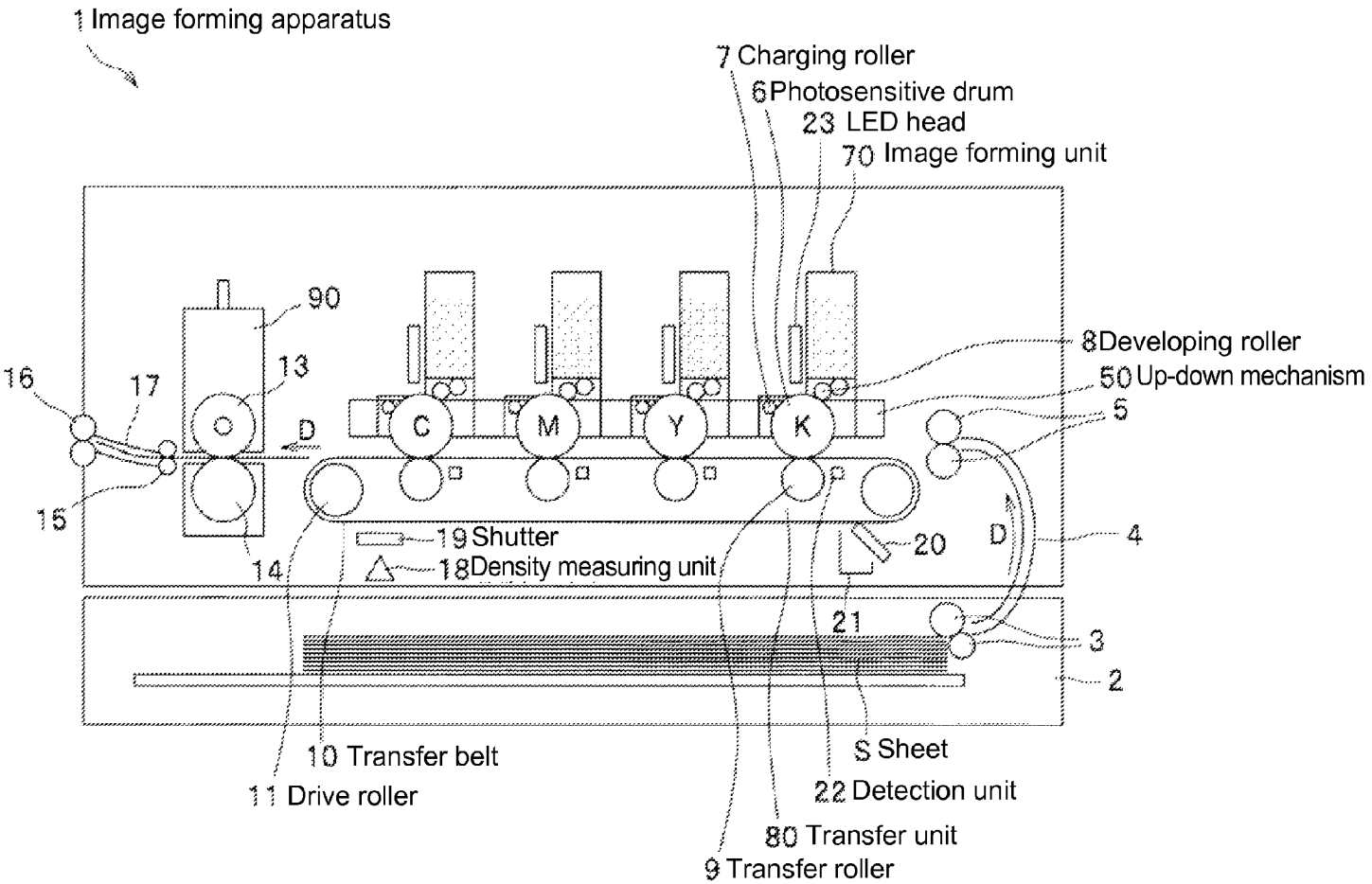
FIG. 1 is a schematic sectional side view showing a configuration of an image forming apparatus according to a first embodiment of the present invention.

Hereunder, embodiments of the present invention will be explained with reference to the accompanying drawings. Note that the accompanying drawings schematically show embodiments of the present invention, and the present invention is not limited to the embodiments shown in the accompanying drawings. In the accompanying drawings, similar components are designated with the same reference numerals, and redundant explanations are omitted.

First Embodiment

According to a first embodiment of the present invention, a configuration of an image forming apparatus 1 will be explained with reference to FIG. 1. FIG. 1 is a schematic sectional side view showing the configuration of the image forming apparatus 1 according to the first embodiment of the present invention. In the following description, the image forming apparatus 1 will be explained as a color printer of an electro-photography type for forming an image in four colors, i.e., black (K), yellow (Y), magenta (M), and cyan (C).

As shown in FIG. 1, the image forming apparatus 1 includes a sheet cassette 2, a sheet supply roller 3, a sheet transportation path 4, transportation rollers 5, image forming units 70, a transfer unit 80, and a fixing unit 90.

In the embodiment, the sheet cassette 2 is provided for retaining a sheet S as a print medium. The sheet cassette 2 is disposed at a lower portion of the image forming apparatus 1. The sheet supply roller 3 is provided for picking up (supplying) the sheet S from the sheet cassette 2 one by one.

In the embodiment, the sheet transportation path 4 is provided for transporting the sheet S. More specifically, the sheet supply roller 3 picks up the sheet S from the sheet cassette 2 one by one, and the sheet S is transported inside the image forming apparatus 1 along the sheet transportation path 4 in an arrow direction D. The transportation rollers 5 are disposed on a downstream side of the sheet transportation path 4 for transporting the sheet S. More specifically, the transportation rollers 5 are provided for transporting the sheet S picked up from the sheet cassette 2 to an image forming unit 70K (described later).

In the embodiment, the image forming units 70 are provided for forming an image to be transferred to the sheet S or a transfer belt 10. More specifically, the image forming units 70 are provided as a plurality of image forming units corresponding to each color of developer, i.e., four image forming units corresponding to each of black (K), yellow (Y), magenta (M), and cyan (C). In the following description, when it is necessary to distinguish a component corresponding to each color, the component is designated with a reference numeral with a character K, Y, M, or C.

In the embodiment, four image forming units 70K, 70Y, 70M, and 70C are arranged from an upstream side to a downstream side in a transportation direction of the sheet S. Accordingly, the image forming apparatus 1 is configured as a printer of a tandem type. Further, the image forming apparatus 1 is configured as a printer of a direct printing type, in which a developer image formed on a photosensitive drum 6 is directly transferred to a transfer medium.

In the embodiment, it is assumed that the image forming unit 70K of black is provided for forming an image in both a monochrome mode and a color mode, and the image forming units 70Y, 70M, and 70C of the other colors are provided for forming images only in the color mode. In the following description, the image forming unit for forming an image in both the monochrome mode and the color mode such as the image forming unit 70K is referred to as a first image forming unit. The other image forming units for forming images only in the color mode such as the image forming units 70Y, 70M, and 70C are referred to as a second image forming unit. Further, developer used in both the monochrome mode and the color mode is referred to as first developer, and developer used only in the color mode is referred to as second developer.

In the embodiment, the image forming unit 70K of black provided as the first image forming unit becomes a black image forming unit for forming a black image in the printing operation in the monochrome mode, and becomes a base pattern forming unit for forming a base pattern as a background in the printing operation in the color mode.

Note that, as far as a color can be used in the base pattern, the base pattern forming unit is not limited to the image forming unit 70K of black, and may be the image forming units 70 of any color. The image forming units 70 have an identical configuration except retaining developer in a different color, and each of the image forming units 70 includes the photosensitive drum 6, a charging roller 7, an LED (Light Emitting Diode) head 23, and a developing roller 8.

In the embodiment, the photosensitive drum 6 is provided as an image supporting member for supporting an image. The photosensitive drum 6 is formed of a base member made of a conductive material such as aluminum and the like and a surface layer made of an organic photosensitive member. The charging roller 7 is provided as a charging member for charging the photosensitive drum 6. A voltage application unit (not shown) applies a charging voltage to the charging roller 7, so that the charging roller 7 charges the photosensitive drum 6.

In the embodiment, the LED head 23 is provided as an exposure unit for forming a static latent image on the photosensitive drum 6 charged with the charging roller 7. The exposure unit or the LED head 23 is provided also as a static latent image forming unit together with the charging unit or the charging roller 7 for forming the static latent image on the photosensitive drum 6. The LED head 23 is formed of a light emitting element array with a plurality of LEDs arranged therein.

Further, the LED head 23 is arranged such that each of the LEDs selectively emits light when a print control unit 200 and an exposure control unit 210 (refer to FIG. 3, described later) send a light emitting direction to the LED head 23 according to image data. The LED head 23 includes a rod lens array and the like for collecting light emitted from each of the LEDs, so that the LED head 23 collects and irradiates light on a surface of the photosensitive drum 6, thereby forming the static latent image on the surface of the photosensitive drum 6. The exposure unit is formed of the LED head 23, and may be formed of a laser light source and the like.

In the embodiment, the developing roller 8 is provided for attaching developer (toner) to the static latent image formed on the photosensitive drum 6 with the LED head 23. A voltage application unit (not shown) applies a developing voltage (corresponding to a developing energy) to the developing roller 8, so that the developing roller 8 attaches developer (toner) to the static latent image to form a developer image (a toner image), thereby visualizing the static latent image.

In the embodiment, the transfer unit 80 is provided for transferring (printing) the developer image (the toner image) to the transfer medium. The transfer medium is defined as a medium to which the developer image formed on the photosensitive drum 6 is transferred, and includes the sheet S or the transfer belt 10. The transfer unit 80 includes transfer rollers 9, the transfer belt 10, and a drive roller 11.

In the embodiment, each of the transfer rollers 9 is provided for transferring the developer image (the toner image) to the transfer medium. As shown in FIG. 1, the transfer rollers 9 are arranged at four locations as transfer rollers 9K, 9Y, 9M, and 9C corresponding to the colors K, Y, M, and C. Further, the transfer rollers 9K, 9Y, 9M, and 9C are arranged at positions facing the corresponding photosensitive drums 6 at a backside surface of the transfer belt 10, so that the transfer rollers 9 and the photosensitive drums 6 sandwich the transfer medium. A voltage application unit (not shown) applies a transfer voltage with a polarity opposite to that of the developer image to the transfer rollers 9, so that the transfer rollers 9 transfer the developer images formed on the photosensitive drums 6 to the transfer medium.

In the embodiment, the transfer belt 10 is provided for transporting the sheet S from the black image forming unit 70K to the fixing unit 90. The transfer belt 10 is formed of a conductive material in an endless shape, and is arranged to contact with the photosensitive drums 6 of the image forming units 70. When color balance is adjusted, density detection test patterns 301 and 302 (refer to FIGS. 4 and 5) are transferred to the transfer belt 10.

In the embodiment, the drive roller 11 is provided for moving the transfer belt 10. The transfer belt 10 wraps around the drive roller 11. A belt drive motor 232 (refer to FIG. 3, described later) drives the drive roller 11 to rotate, so that the drive roller 11 moves the transfer belt 10.

In the embodiment, the fixing unit 90 is provided for performing a fixing process (that is, the developer image transferred to the sheet S is fixed to the sheet S). The fixing unit 90 includes a fixing roller 13 and a pressing roller 14.

In the embodiment, the fixing roller 13 is provided for heating the developer image. The fixing roller 13 includes a fixing heat generation member (not shown) therein or on a circumferential portion thereof. The pressing roller 14 is provided for pressing the sheet S against the fixing roller 13. The pressing roller 14 is arranged to face the fixing roller 13, and an urging member (not shown) urges the pressing roller 14 against the fixing roller 13. The fixing roller 13 and the pressing roller 14 sandwich the sheet S to heat and press the sheet S, so that the developer image transferred to the sheet S is melt and fixed to the sheet S.

In the embodiment, the image forming apparatus 1 further includes a fixing transportation roller 15, a discharge roller 16, a discharge transportation path 17, a density measuring unit 18, a shutter 19, a cleaning blade 20, a toner box 21, detection units 22, and an up-down mechanism 50.

In the embodiment, the fixing transportation roller 15 is provided for transporting the sheet S fixed with the fixing unit 90 from the fixing unit 90 toward a downstream side. The discharge roller 16 is provided for transporting the sheet S transported with the fixing transportation roller 15 further toward a discharge outlet, so that the sheet S is discharged outside the image forming apparatus 1. The discharge transportation path 17 is a transportation path disposed between the fixing unit 90 and the discharge outlet.

In the embodiment, the density measuring unit 18 is provided for measuring a density of the developer image (or the test pattern) transferred to the transfer belt 10. The density measuring unit 18 is formed of an optical sensor including a light emitting portion and a light receiving portion, so that the density measuring unit 18 measures a density of the developer image in black or the developer image in other colors. The density measuring unit 18 measures the density represented with an OD (Optical Density) value. The OD value represents a density of a printed object using a light transmittance.

In the embodiment, the shutter 19 is provided for opening and closing between the transfer belt 10 and the density measuring unit 18. When the density measuring unit 18 does not measure a density, the shutter 19 becomes a closed state, so that the shutter 19 blocks between the transfer belt 10 and the density measuring unit 18. Accordingly, the shutter 19 prevents a foreign matter such as toner from attaching to the density measuring unit 18 in the image forming apparatus 1. When the density measuring unit 18 does measure a density, the shutter 19 becomes an opened state, so that the shutter 19 opens between the transfer belt 10 and the density measuring unit 18. Accordingly, the density measuring unit 18 of the image forming apparatus 1 measures the density of the developer image (or the test pattern) transferred to the transfer belt 10.

In the embodiment, the cleaning blade 20 is arranged to abut against the transfer belt 10, so that the cleaning blade 20 scrapes off a foreign matter (referred to an attached substance) attached to the transfer belt 10. The toner box 21 is provided for collecting the attached substance scraped off with the cleaning blade 20.

In the embodiment, the detection units 22 are provided for detecting whether each of the image forming units 70 is situated at a first position or a second position during the printing operation. When one of the image forming units 70 is situated at the first position, the photosensitive drum 6 of the one of the image forming units 70 contacts with the transfer belt 10. When one of the image forming units 70 is situated at the second position, the photosensitive drum 6 of the one of the image forming units 70 is away from the transfer belt 10. The detection units 22 are disposed at four locations as detection units 22K, 22Y, 22M, and 22C corresponding to the colors K, Y, M, and C. The detection units 22K, 22Y, 22M, and 22C are situated in surrounding areas of the image forming units 70. Each of the detection units 22 may be formed of an optical sensor or a contact type sensor.

In the embodiment, the up-down mechanism 50 is provided for selectively lifting or lowering each of the image forming units 70. When the up-down mechanism 50 selectively lifts or lowers one of the image forming units 70, it is possible to selectively contact or separate the one of the image forming units 70 with or from the transfer belt 10. In other words, the up-down mechanism 50 is provided for selectively moving the first image forming unit (the image forming unit 70K of black) to one of the first position and the second position, and for selectively moving the second image forming unit (the image forming units 70Y, 70M, and 70C) to one of the first position and the second position.

It is preferred that the up-down mechanism 50 selectively moves each of the image forming units 70 in the following three arrangements. In the first arrangement, when the image forming apparatus 1 performs the printing operation in the monochrome mode, the up-down mechanism 50 moves only the image forming unit 70K of black to contact with the transfer belt 10, and moves the image forming units 70Y, 70M, and 70C away from the transfer belt 10. In the second arrangement, when the image forming apparatus 1 performs the printing operation in the color mode, the up-down mechanism 50 moves all of the image forming units 70K, 70Y, 70M, and 70C to contact with the transfer belt 10. In the third arrangement, when the image forming apparatus 1 is in an idle state and does not perform the printing operation, the up-down mechanism 50 moves all of the image forming units 70K, 70Y, 70M, and 70C away from the transfer belt 10.

More specifically, when the image forming apparatus 1 performs the printing operation in the monochrome mode, the up-down mechanism 50 lowers only the image forming unit 70K of black, and lifts the image forming units 70Y, 70M, and 70C. Accordingly, in the monochrome mode, only the image forming unit 70K of black is situated at the first position (that is, the position where the photosensitive drum 6 contacts with the transfer belt 10), and the image forming units 70Y, 70M, and 70C are situated at the second position (that is, the position where the photosensitive drum 6 is away from the transfer belt 10).

Further, when the image forming apparatus 1 performs the printing operation in the color mode, the up-down mechanism 50 lowers all of the image forming units 70K, 70Y, 70M, and 70C. Accordingly, in the color mode, the up-down mechanism 50 moves the image forming units 70K, 70Y, 70M, and 70C to the first position.

Further, when the image forming apparatus 1 is in the idle state and does not perform the printing operation, the up-down mechanism 50 lifts all of the image forming units 70K, 70Y, 70M, and 70C. As a result, it is possible to prevent the photosensitive drums 6 and the transfer belt 10 from deteriorating due to contact friction therebetween, and to prevent stain of the image forming units 70 from transferring to the transfer belt 10. Accordingly, in the idle state, the up-down mechanism 50 moves the image forming units 70K, 70Y, 70M, and 70C to the second position.

Figure 2:
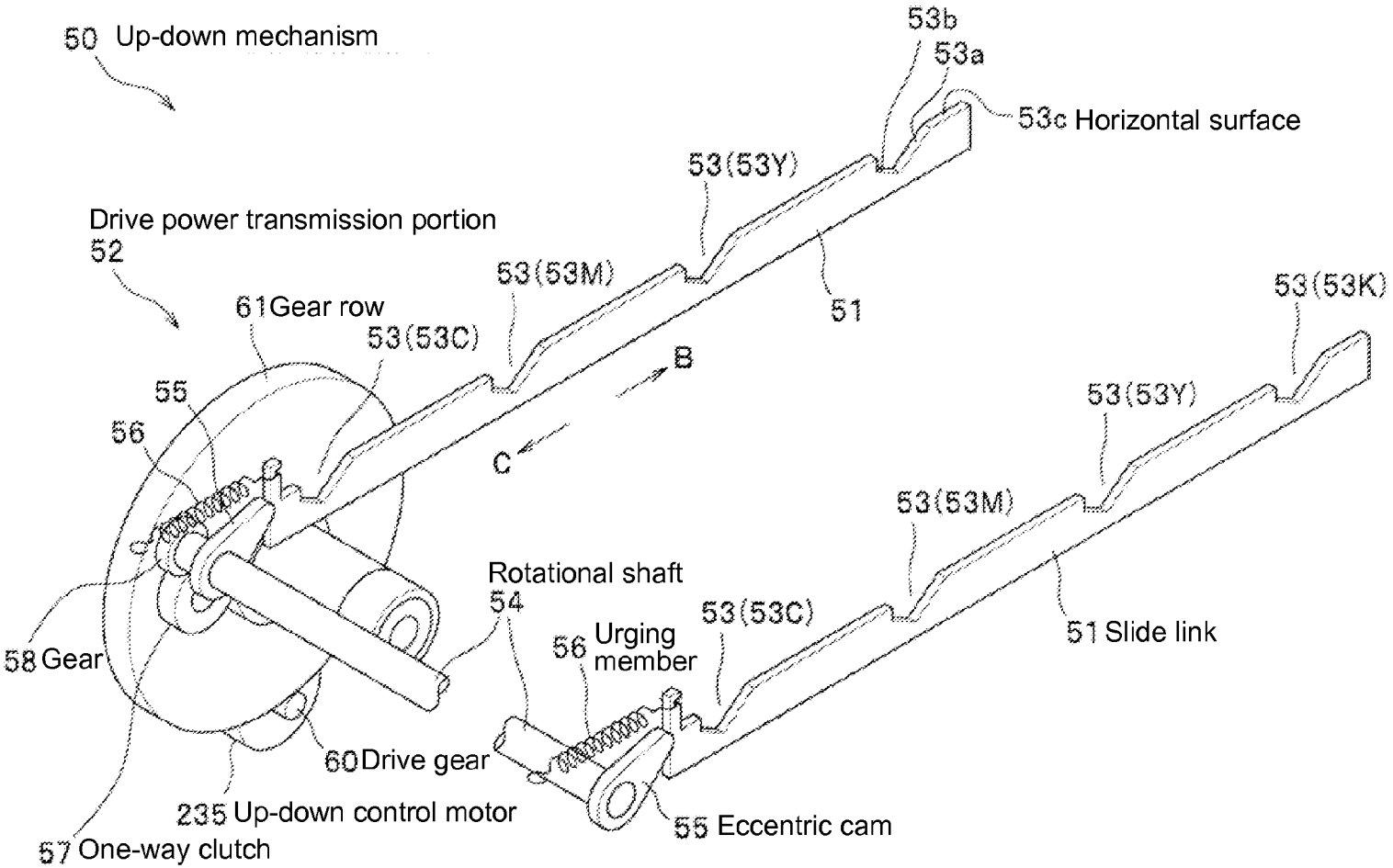
FIG. 2 is a schematic perspective view showing an up-down mechanism of the image forming apparatus according to the first embodiment of the present invention.

A configuration of the up-down mechanism 50 will be explained in more detail with reference to FIG. 2. FIG. 2 is a schematic perspective view showing the up-down mechanism 50 of the image forming apparatus 1 according to the first embodiment of the present invention.

As shown in FIG. 2, the up-down mechanism 50 includes the up-down control motor 235, a drive power transmission portion 52, and slide links 51. The up-down control motor 235 is provided as a drive source of the up-down mechanism 50 for supplying drive power to the drive power transmission portion 52. The drive power transmission portion 52 transmits the drive power from the up-down control motor 235 to the slide links 51, so that the slide links 51 move in a reciprocatory motion in an arrow direction B or an arrow direction C. The slide links 51 are formed of plate shape members for supporting drum shafts (not shown) of the photosensitive drums 6 of the image forming units 70 from below. It is noted that the drum shafts protrude from sidewalls of the image forming units 70.

In the embodiment, as explained above, the up-down control motor 235 is provided as the drive source of the up-down mechanism 50. At least one of drive motors of the image forming units 70 used in the printing operation may be used as the drive source of the up-down mechanism 50. For example, the drive motor for driving the image forming unit 70C of cyan, located at a furthermost position from the image forming unit 70K of black, may be used as the drive source of the up-down mechanism 50.

In the embodiment, the drive power transmission portion 52 includes a rotational shaft 54, eccentric cams 55, urging members 56, a one-way clutch 57, a gear 58, a drive gear 60, and a gear row 61. The rotational shaft 54 is a member extending in a direction crossing the slide links 51.

In the embodiment, the eccentric cams 55 are fixed to the rotational shaft 54. When the rotational shaft 54 rotates, the eccentric cams 55 move the slide links 51 in the reciprocatory motion in the arrow direction B or the arrow direction C. The urging members 56 are provided for urging the slide links 51 in the arrow direction C, so that the slide links 51 abut against the eccentric cams 55.

In the embodiment, when the image forming units 70K, 70Y, 70M, and 70C move upwardly (that is, the image forming units 70K, 70Y, 70M, and 70C move from the first position to the second position), the one-way clutch 57 engages the rotational shaft 54. Accordingly, the rotational drive force of the up-down control motor 235 transmitted through the drive gear 60, the gear row 61, and the gear 58 is transmitted to the rotational shaft 54, thereby rotating the rotational shaft 54. The gear 58 engages the rotational shaft 54 through the one-way clutch 57, so that the rotational drive force of the up-down control motor 235 transmitted through the drive gear 60 and the gear row 61 is transmitted to the one-way clutch 57.

In the embodiment, the up-down control motor 235 drives the drive gear 60 to rotate, so that the rotational drive force of the up-down control motor 235 is transmitted to the gear row 61, thereby rotating the gear row 61. The gear row 61 is disposed between the drive gear 60 and the gear 58, so that the rotational drive force of the up-down control motor 235 transmitted through the drive gear 60 is transmitted to the gear 58, thereby rotating the gear 58.

In the embodiment, the slide links 51 are arranged as a pair on both sides of the photosensitive drums 6 of the image forming units 70. More specifically, a pair of the slide links 51 is arranged in a standing posture to extend in parallel. As explained above, the slide links 51 are arranged to move in the reciprocatory motion in the arrow direction B or the arrow direction C crossing the ascend direction or the descent direction of the image forming units 70.

As shown in FIG. 2, each of the slide links 51 includes guide grooves 53. When each of the slide links 51 slides, the drum shafts (not shown), i.e., a rotational center of the photosensitive drums 6 of the image forming units 70, are accommodated in the guide grooves 53. The guide grooves 53 are formed as guide grooves 53K, 53Y, 53M, and 53C at four locations corresponding to the colors K, Y, M, and C.

In the embodiment, each of the guide grooves 53K, 53Y, 53M, and 53C includes two inclined surfaces (referred to as a first guide surface 53*a* and a second guide surface 53*b*). The first guide surface 53*a* is formed on the guide groove 53 on a side of the transportation roller 5 (refer to FIG. 1). The second guide surface 53*b* is formed on the guide groove 53 on a side of the fixing unit 90 (refer to FIG. 1).

In the embodiment, when the slide links 51 slide, the first guide surfaces 53*a* and the second guide surfaces 53*b* guide the drum shafts of the photosensitive drums 6 in the ascend direction or the descent direction. It is noted that the photosensitive drums 6 are integrated with the image forming units 70. Accordingly, when the photosensitive drums 6 move in the ascend direction or the descent direction, the image forming units 70 move in the ascend direction or the descent direction as well. As a result, the first guide surfaces 53*a* and the second guide surfaces 53*b* guide the image forming units 70 through the drum shafts of the photosensitive drums 6 in the ascend direction or the descent direction.

In the embodiment, the first guide surfaces 53*a* are connected to the second guide surfaces 53*b* at a deepest portion of the guide grooves 53. Each of the first guide surfaces 53*a* has a flat front surface, and each of the second guide surfaces 53*b* has an end portion formed as a vertical wall, so that the vertical wall regulates the movement of the drum shaft of the photosensitive drum 6.

In the embodiment, the guide grooves 53 may have a modified shape according to a shape of the image forming units 70. For example, the guide groove 53K corresponding to the image forming unit 70K of black may have a recess portion with a width smaller than that of recess portions of the guide grooves 53Y, 53M, and 53C corresponding to the image forming units 70Y, 70M, and 70C. When the guide grooves 53 have the shapes described above, in the monochrome mode, it is possible to contact only the image forming unit 70K of black with the transfer belt 10, and to separate the image forming units 70Y, 70M, and 70C from the transfer belt 10.

An operation of the up-down mechanism 50 will be explained next. In an initial state, the image forming apparatus 1 is in the idle state. In the idle state, the slide links 51 support the drum shafts of the photosensitive drums 6 at horizontal surfaces 53*c* thereof extending in a horizontal direction.

When the image forming apparatus 1 performs the printing operation in the monochrome mode, the slide links 51 start sliding in the arrow direction B. Accordingly, the drum shafts of the photosensitive drums 6 of all of the image forming units 70K, 70Y, 70M, and 70C are accommodated in the guide grooves 53. Afterward, the slide links 51 further slide in the arrow direction B, so that the drum shafts of the photosensitive drums 6 move downwardly along the first guide surfaces 53*a* of the guide grooves 53. Accordingly, all of the image forming units 70K, 70Y, 70M, and 70C move downwardly following the drum shafts of the photosensitive drums 6. As a result, all of the image forming units 70K, 70Y, 70M, and 70C are situated at the first position.

As explained above, when the image forming units 70K, 70Y, 70M, and 70C are situated at the first position, the photosensitive drums 6 of the image forming units 70K, 70Y, 70M, and 70C contact with the transfer belt 10. In other words, the first position may be considered as an image forming position of the image forming units 70.

After the image forming units 70K, 70Y, 70M, and 70C move to the first position, the slide links 51 further slide in the arrow direction B. Accordingly, the drum shafts of the photosensitive drums 6 of the image forming units 70Y, 70M, and 70C, other than that of the image forming unit 70K of black, move upwardly along the second guide surfaces 53*b* of the guide grooves 53. Accordingly, the image forming units 70Y, 70M, and 70C move upwardly following the drum shafts of the photosensitive drums 6. As a result, only the image forming unit 70K of black remains at the first position or the image forming position, and the image forming units 70Y, 70M, and 70C are situated at the second position.

As explained above, when the image forming units 70K, 70Y, 70M, and 70C are situated at the second position, the photosensitive drums 6 of the image forming units 70K, 70Y, 70M, and 70C are away from the transfer belt 10. In other words, the second position may be considered as a non-image forming position of the image forming units 70.

When the image forming apparatus 1 performs the printing operation in the color mode after the image forming apparatus 1 performs the printing operation in the monochrome mode, the slide links 51 start sliding in the arrow direction C. Accordingly, the drum shafts of the photosensitive drums 6 of the image forming units 70Y, 70M, and 70C, other than that of the image forming unit 70K of black, move downwardly along the second guide surfaces 53*b* of the guide grooves 53. Accordingly, the image forming units 70Y, 70M, and 70C move downwardly following the drum shafts of the photosensitive drums 6. As a result, all of the image forming units 70K, 70Y, 70M, and 70C are situated at the first position.

After the image forming apparatus 1 performs the printing operation in the color mode and the monochrome mode, the image forming apparatus 1 becomes the idle state. In the idle state, the slide links 51 slide in the arrow direction C, so that the slide links 51 support the drum shafts of the photosensitive drums 6 at the horizontal surfaces 53*c* thereof. As a result, all of the image forming units 70K, 70Y, 70M, and 70C are situated at the second position.

Figure 3:
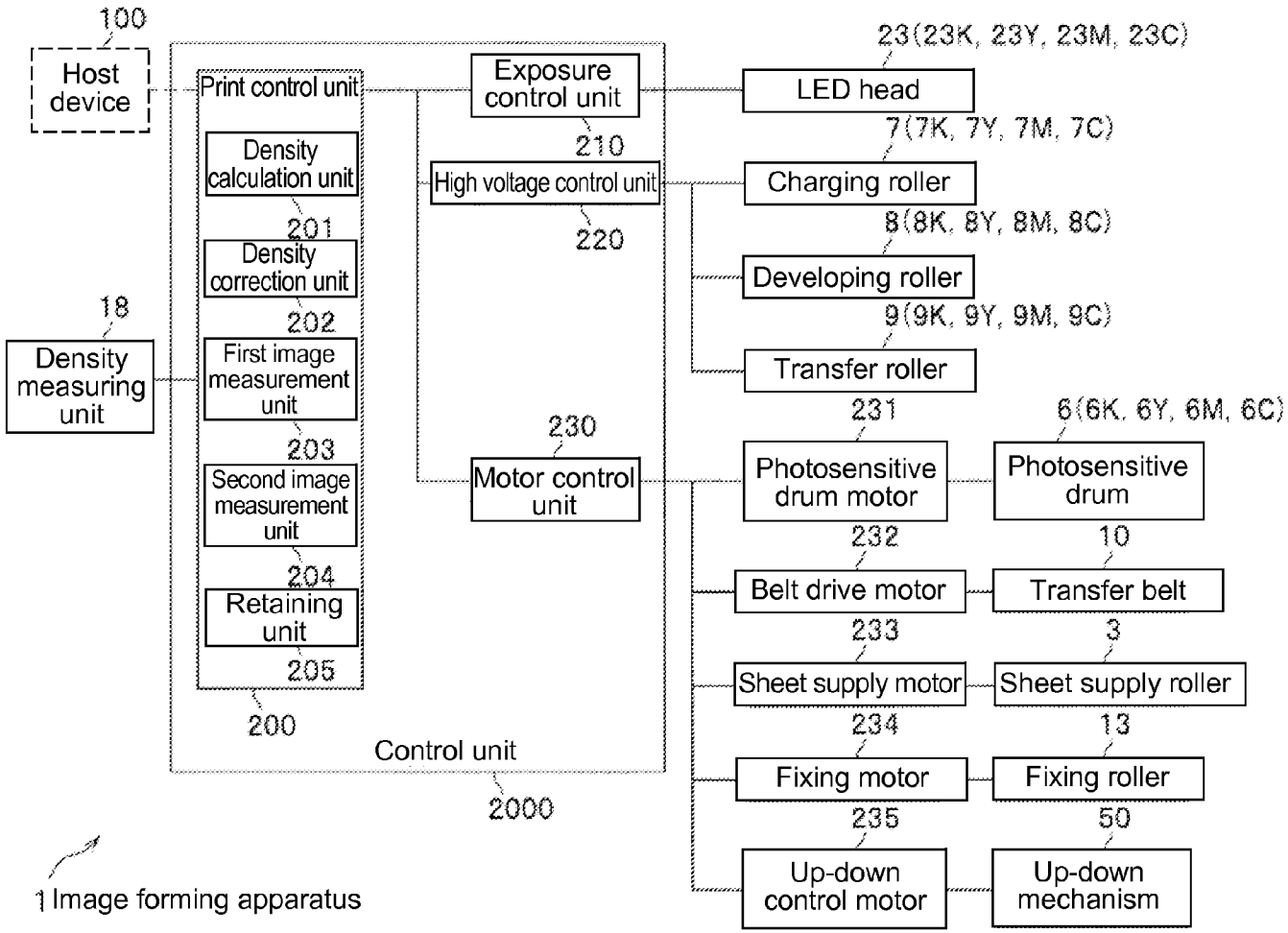
FIG. 3 is a block diagram showing a functional system of the image forming apparatus according to the first embodiment of the present invention.

A functional system of the image forming apparatus 1 will be explained with reference to FIG. 3. FIG. 3 is a block diagram showing the functional system of the image forming apparatus 1 according to the first embodiment of the present invention.

As shown in FIG. 3, the image forming apparatus 1 includes a control unit 2000 for controlling an entire operation of the image forming apparatus 1. The control unit 2000 includes a print control unit 200, an exposure control unit 210, a high voltage control unit 220, and a motor control unit 230. These units are realized through a CPU, an RIM, a RAM, and a program.

In the embodiment, the print control unit 200 is provided for controlling an entire operation of the image forming apparatus 1 during the printing operation thereof. The exposure control unit 210 is provided for controlling an exposure operation of the exposure units of the image forming units 70 (the LED heads 23K, 23Y, 23M, and 23C). The high voltage control unit 220 is provided for controlling an application operation of the voltages to be applied to the charging members of the image forming units (the charging rollers 7K, 7Y, 7M, and 7C), the developing units of the image forming units 70 (the developing rollers 8K, 8Y, 8M, and 8C), and the transfer rollers 9K, 9Y, 9M, and 9C of the image forming units 70.

In the embodiment, the motor control unit 230 is provided for controlling a rotational operation of a photosensitive drum motor 231, the belt drive motor 232, a sheet supply motor 233, a fixing motor 234, and the up-down control motor 235. The photosensitive drum motor 231 is provided as a drive source for driving the photosensitive drums 6K, 6Y, 6M, and 6C of the image forming units 70K, 70Y, 70M, and 70C. The belt drive motor 231 is provided as a drive source for driving the transfer belt 10. The sheet supply motor 233 is provided as a drive source for driving the sheet supply roller 3. The fixing motor 234 is provided as a drive source for driving the fixing roller 13.

In the embodiment, the print control unit 200 is configured to send various instructions to each of the functional units described above. For example, when a host device 100 sends a print instruction to the print control unit 200, the print control unit 200 sends a control signal for instructing the exposure operation to the exposure control unit 210. When the exposure control unit 210 receives the control signal, the exposure control unit 210 controls the LED heads 23K, 23Y, 23M, and 23C to emit light, thereby exposing the photosensitive drums 6K, 6Y, 6M, and 6C.

In this case, the print control unit 200 sends a control signal for instructing the charging operation, the developing operation, and the transfer operation to the high voltage control unit 220. When the high voltage control unit 220 receives the control signal, the high voltage control unit 220 controls the voltage application units to apply specific voltages to the charging rollers 7K, 7Y, 7M, and 7C, the developing rollers 8K, 8Y, 8M, and 8C, and the transfer rollers 9K, 9Y, 9M, and 9C.

Further, in this case, the print control unit 200 sends a control signal for instructing the transportation operation of the transfer medium to the motor control unit 230. When the motor control unit 230 receives the control signal, the motor control unit 230 controls the up-down control motor 235 to rotate such that each of the image forming units 70 is situated at a specific position corresponding to the printing mode. Further, the motor control unit 230 controls the photosensitive drum motor 231, the belt drive motor 232, the sheet supply motor 233, and the fixing motor 234 to rotate such that the transfer medium is transported at a specific operation timing and a specific rotational speed.

In the embodiment, when the color balance is adjusted, the print control unit 200 sends a control signal to the motor control unit 230 for specifying the position of each of the image forming units 70. When the motor control unit 230 receives the control signal in the printing operation in the monochrome mode, the motor control unit 230 controls the up-down control motor 235 to lower and stop only the image forming unit 70K of black at the first position. When the motor control unit 230 receives the control signal in the printing operation in the color mode, the motor control unit 230 controls the up-down control motor 235 to lower and stop all of the image forming units 70K, 70Y, 70M, and 70C at the first position.

In the embodiment, the detection units 22 sends a signal indicating the position of each of the image forming units 70 to the print control unit 200 in the printing operation in the monochrome mode and the color mode. When the print control unit 200 receives the signal, the print control unit 200 sends a control signal for instructing the exposure operation to the exposure control unit 210. Further, the print control unit 200 sends a control signal for instructing the charging operation, the developing operation, and the transfer operation to the high voltage control unit 220, and sends a control signal for instructing the transportation operation of the transfer medium to the motor control unit 230. Through the process described above, the print control unit 200 forms the test pattern 301 and the test pattern 302 (refer to FIG. 4, described later) on the transfer belt 10 (refer to FIG. 1).

In the embodiment, the print control unit 200 includes a density calculation unit 201, a density correction unit 202, image measurement units 203 and 204 (referred to as a first image measurement unit 203 and a second image measurement unit 204), and a retaining unit 205.

In the embodiment, the density calculation unit 201 is provided for calculating a correction value for adjusting the color balance. More specifically, the density calculation unit 201 is provided for calculating a correction value so that a density value of the common color (black) in the color mode matches to a density value of the common color in the monochrome mode. Then, the density calculation unit 201 calculates a control value to be instructed to the exposure control unit 210 and the high voltage control unit 220 according to the correction value thus calculated.

In the embodiment, the density correction unit 202 is provided for generating the control signal for instructing the exposure operation according to the control value calculated with the exposure control unit 210. More specifically, the density correction unit 202 sends a correction value of a light amount (referred to as a light amount correction value) to the exposure control unit 210 as a correction value of an exposure light energy (that is, an energy amount of light to be irradiated to the photosensitive drums 6).

In general, when a light amount of the exposure units (the LED heads 23) is adjusted, a density of a printed image changes. More specifically, when a light amount of the exposure units (the LED heads 23) is adjusted, an exposure amount of the photosensitive drum 6 changes, thereby changing a toner amount to be attached to the photosensitive drum 6. For instance, when the light amount of the exposure units (the LED head 23) is increased, the toner amount to be attached to the photosensitive drum 6 increases. As a result, the density of the printed image increases. On the other hand, when the light amount of the exposure units (the LED head 23) is decreased, the toner amount to be attached to the photosensitive drum 6 decreases. As a result, the density of the printed image decreases.

In the embodiment, the density correction unit 202 is provided for generating the control signal for instructing the charging operation, the developing operation, and the transfer operation according to the control value calculated with the exposure control unit 210, and for sending the control signal to the high voltage control unit 220. More specifically, the density correction unit 202 sends a correction value of the developing voltage (referred to as a developing voltage correction value) to the high voltage control unit 220 as a correction value of a developing energy (that is, an energy amount defined by one or a combination of the developing voltage, the supply voltage, and the charging voltage).

In the embodiment, the first image measurement unit 203 is provided for printing the test pattern 301 (refer to FIGS. 4 and 5, described later) in the printing operation in the monochrome mode, so that the density measuring unit 18 measures a density value of the test pattern 301.

More specifically, the first image measurement unit 203 is provided for sending a control signal to the functional units for instructing the printing operation of the test pattern 301 in the monochrome mode, such that the test pattern 301 is printed in the state that only the image forming unit 70K of the common color (black) is situated at the first position (that is, only the image forming unit 70K of black contacts with the transfer belt 10). Accordingly, the image forming unit 70K of black performs the printing operation in the monochrome mode, so that the test pattern 301 is transferred to the transfer belt 10. Then, the density measuring unit 18 measures the density value of the test pattern 301 transferred (printed) to the transfer belt 10.

In the embodiment, the second image measurement unit 204 is provided for printing the test pattern 302 (refer to FIGS. 4 and 5, described later) in the printing operation in the color mode, so that the density measuring unit 18 measures a density value of the common color (black) of the test pattern 302.

More specifically, the second image measurement unit 204 is provided for sending a control signal to the functional units for instructing the printing operation of the test pattern 302 in the color mode, such that the test pattern 302 is printed in the state that all of the image forming units 70K, 70Y, 70M, and 70C are situated at the first position (that is, all of the image forming units 70K, 70Y, 70M, and 70C contact with the transfer belt 10). Accordingly, all of the image forming units 70K, 70Y, 70M, and 70C perform the printing operation in the color mode, so that the test pattern 302 is transferred to the transfer belt 10. Then, the density measuring unit 18 measures the density value of the common color (black) of the test pattern 302 transferred (printed) to the transfer belt 10.

As described above, in the embodiment, when the color balance is adjusted, the test pattern 301 and the test pattern 302 modified with a specific improvement are printed on the transfer belt 10, thereby measuring the densities of the test pattern 301 and the test pattern 302. Then, it is configured to correct the density of a low duty image of the common color (black) in the color mode according to the density values of the test pattern 301 and the test pattern 302.

In the embodiment, the low duty image may include a one-by-one dot pattern. In the one-by-one dot pattern (referred to as a one-by-one pattern), dots of one pixel formed of one pixel in a main scanning direction and one pixel in a sub-scanning direction are arranged at a plurality of locations within a specific range according to a specific format.

Recently, the one-by-one pattern has been known as a dot pattern for a base pattern, and has been used in a digital pen solution technology (Anoto solution) developed by Anoto in Sweden or an invisible two-dimension code application solution technology (Grid Onput solution) developed by Prof. Kenji Yoshida at Hosei University.

In Anoto solution, different patterns are drawn per grid using small dots with a specific interval in between. In this case, a digital pen with a digital camera embedded therein is used to detect the patterns printed on a sheet, so that a position can be identified. In Grid Onput solution, a color image is overlapped on a dot pattern for a base pattern.

For instance, when Grid Onput solution is realized with the image forming apparatus 1 constituted as the color printer of the electro-photography type of the four colors K, Y, M, and C, the image forming apparatus 1 forms a dot pattern for a base pattern on the photosensitive drum 6K in the common color (black), and transfers the dot pattern to the sheet S. Further, the image forming apparatus 1 forms dot patterns for a base pattern on the photosensitive drums 6Y, 6M, and 6C in the other colors (Y, M, and C) other than the common color, and transfers the dot patterns to the sheet S.

In general, it is preferred that each of the dots constituting the dot pattern for the base pattern has a size small enough for a user to not visually recognize. It is known that, although there is a difference depending on individuals, a visually recognizable size of a dot is about 60 μm to 80 μm. Accordingly, when the dot has a size smaller than the range, it is not possible to visually recognize the dot.

When the image forming apparatus 1 performs the printing operation in a resolution of 600 psi×600 psi, each of the dots constituting the one-by-one pattern has a size of 40 μm strong. Accordingly, in this case, it is not possible to visually recognize the dots of the one-by-one pattern. Therefore, it can be said that the one-by-one pattern is suitable for the base pattern.

In general, the dot pattern for the base pattern transferred to the sheet S is required to meet the following three requirements. In the first requirement, it is necessary that a reading scanner specialized for reading the base pattern can securely recognize the dots. In the second requirement, it is necessary that the dots thus recognized can be properly converted to a code. In the third requirement, it is necessary that the dots thus recognized are printed in a size small enough for a user to not visually recognize.

When the color printer of the electro-photography type prints the on-by-one pattern, and toner of black is reversely transferred (attached) to the photosensitive drums 6Y, 6M, and 6C of the image forming units 70Y, 70M, and 70C, the dots of the one-by-one pattern tend to be unrecognizable as explained below.

That is, when the image forming apparatus 1 performs the printing operation in the color mode, the color images in all colors are printed and overlapped on the one-by-one patterns in the state that all of the image forming units 70K, 70Y, 70M, and 70C are situated at the first position (more specifically, all of the image forming units 70K, 70Y, 70M, and 70C contact with the transfer belt 10). In this case, first, the developer image of black in the one-by-one pattern is transferred to the transfer belt 10. Then, before the developer image of black in the one-by-one pattern is fixed to the sheet S, the transfer belt 10 contacts with the photosensitive drums 6Y, 6M, and 6C of the image forming units 70Y, 70M, and 70C. As a result, a part of the developer image of black in the one-by-one pattern may be reversely transferred to the photosensitive drums 6Y, 6M, and 6C of the image forming units 70Y, 70M, and 70C.

When a part of the developer image of black in the one-by-one pattern is reversely transferred, the image forming apparatus 1 may form a printed image having a density deviated from a target value. Through an experiment, when the image forming apparatus 1 constituted as the color printer of the electro-photography type in the four colors K, Y, M, and C performed the printing operation in the color mode, it was confirmed that the image forming unit 70K formed a printed image having a density deviated from a target value to a maximum extent.

Accordingly, it is preferred that the image forming apparatus 1 does not exhibit such a phenomenon (in which, a printed image has a density deviated from a target value). To this end, in the image forming apparatus 1, it is necessary to correct the density of the image such that the image printed in the monochrome mode has the same density as that of the image with propensity to the phenomenon to a maximum extent (the image formed with the image forming unit 70K of black, and printed in the color mode).

A method of correcting the density will be explained next. First, the image forming apparatus 1 prints the test pattern 301 shown in FIGS. 4 and 5 in the monochrome mode, so that the density of the developer image of the test pattern 301 transferred to the transfer belt 10 is measured. In the next step, the image forming apparatus 1 prints the test pattern 302 shown in FIGS. 4 and 5 in the color mode, so that the density of the developer image of the test pattern 302 transferred to the transfer belt 10 is measured. In the next step, the image forming apparatus 1 compares the density of the low duty image (an image of a one-by-one pattern 301*a*, described later) of the test pattern 301 in the common color (black) with the density of the low duty image (an image of a one-by-one pattern 302*a*, described later) of the test pattern 302 in the common color (black) to calculate a correction value. In the next step, the image forming apparatus 1 corrects the density of the low duty image (the image of the one-by-one pattern 302*a*) of the test pattern 302 in the common color printed in the color mode according to the correction value. Through the process described above, the density is corrected.

In the embodiment, the duty represents a print density, and is defined as a sum of average densities of the colors K, Y, M, and C at a specific location in a specific range. A middle duty density is in a range of 30% to 80%, and a high duty density is greater than 60%. The middle duty density is smaller than the high duty density and is greater than a one-by-one density (the one-by-one density<the middle duty density<the high duty density).

Figure 4:
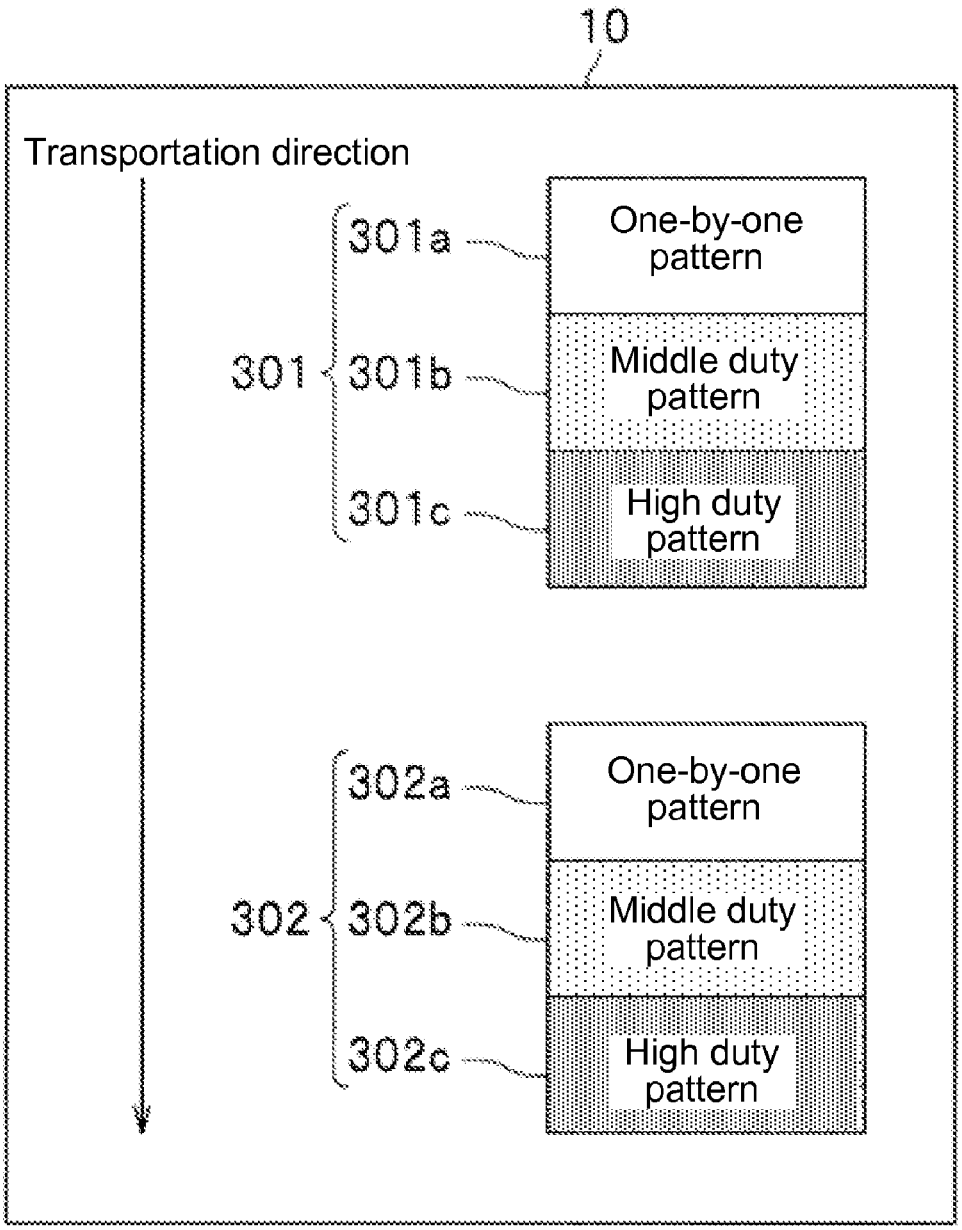
FIG. 4 is a schematic view No. 1 showing a test pattern of the image forming apparatus according to the first embodiment of the present invention.
Figure 5:
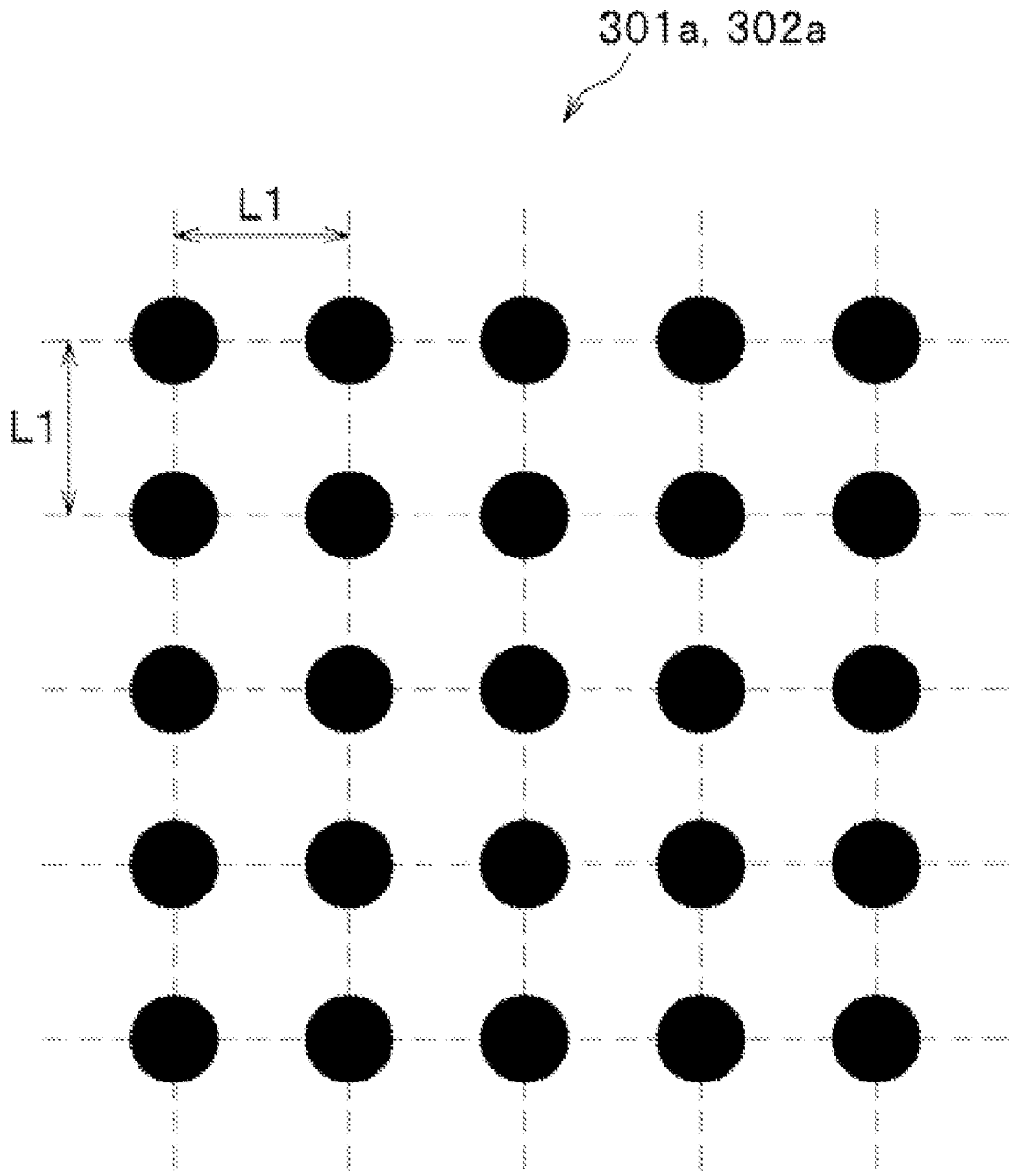
FIG. 5 is a schematic view No. 2 showing the test pattern of the image forming apparatus according to the first embodiment of the present invention.

The test patterns 301 and 302 used in the first embodiment will be explained next in more detail with reference to FIGS. 4 and 5. FIG. 4 is a schematic view No. 1 showing the test patterns 301 and 302 of the image forming apparatus 1 according to the first embodiment of the present invention. FIG. 5 is a schematic view No. 2 showing the test patterns 301 and 302 of the image forming apparatus 1 according to the first embodiment of the present invention.

In the embodiment, the test pattern 301 is formed when the image forming apparatus 1 performs the printing operation in the monochrome mode. The test pattern 301 includes an image of the one-by-one pattern 301*a* (referred to as the one-by-one pattern) as an image of the low duty pattern (referred to as the low duty pattern); an image of the middle duty pattern 301*b* (referred to as the middle duty pattern); and an image of the high duty pattern 301*c* (referred to as the high duty pattern). The one-by-one pattern 301*a*, the middle duty pattern 301*b*, and the high duty pattern 301*c* are printed in the common color (black).

In the conventional art disclosed in Patent Reference (refer to the section "BACKGROUND OF THE INVENTION AND RELATED ART STATEMENT"), a conventional test pattern includes low duty images in the four colors K, Y, M, and C, middle duty images in the four colors K, Y, M, and C, and high duty images in the four colors K, Y, M, and C. On the other hand, in the embodiment of the present invention, the test pattern 301 includes the one-by-one pattern 301*a*, the middle duty pattern 301*b*, and the high duty pattern 301*c* only in the common color (black). Further, instead of the low duty image, the one-by-one pattern 301*a* is printed.

In the embodiment, the test pattern 302 is formed when the image forming apparatus 1 performs the printing operation in the color mode. Similarly to the test pattern 301, the test pattern 302 includes a one-by-one pattern 302*a* as a low duty image; a middle duty pattern 302*b*; and a high duty pattern 302*c*. The one-by-one pattern 302*a*, the middle duty pattern 302*b*, and the high duty pattern 302*c* are printed in the common color (black). The test pattern 302 has a density different from that of the test pattern 301. It is note that the test pattern 301 is printed away from the test pattern 302 by a sufficient distance in consideration of a transition time from the monochrome mode to the color mode.

FIG. 5 is an enlarged schematic view showing the one-by-one patterns 301*a* and 302*a* of the test patterns 301 and 302 printed as the low duty images. As shown in FIG. 5, in the one-by-one patterns 301*a* and 302*a* of the test patterns 301 and 302, a large number of dots are arranged with an interval L1 in a main scanning direction and a sub-scanning direction. It is preferred that the interval L1 is equal to about twice of a dot diameter, for example, about 84.7 μm in a case of the resolution of 600 psi.

In the embodiment, when each of the dots is printed to have an ideal size (more specifically, the dots are formed in a circle with a diameter of 42.3 μm), the one-by-one patterns 301*a* and 302*a* have a print density of about 10% as a print density of black on the transfer belt 10. In the test pattern 301 and the test pattern 302, the middle duty patterns 301*b* and 302*b*, and the high duty patterns 301*c* and 302*c* may have an arbitrary pattern defined in advance.

Figure 6:
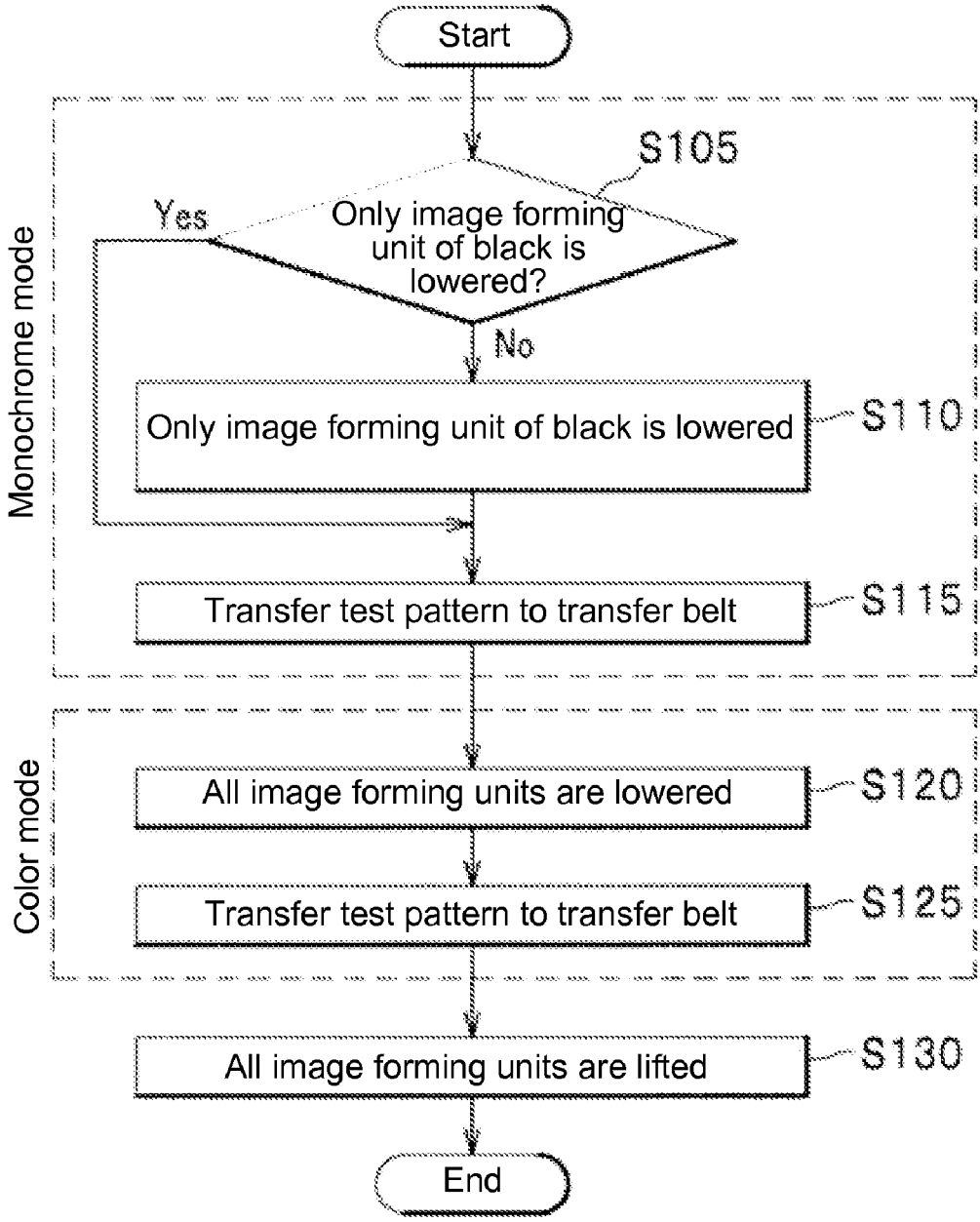
FIG. 6 is a flow chart No. 1 showing an operation of the image forming apparatus according to the first embodiment of the present invention.
Figure 7:
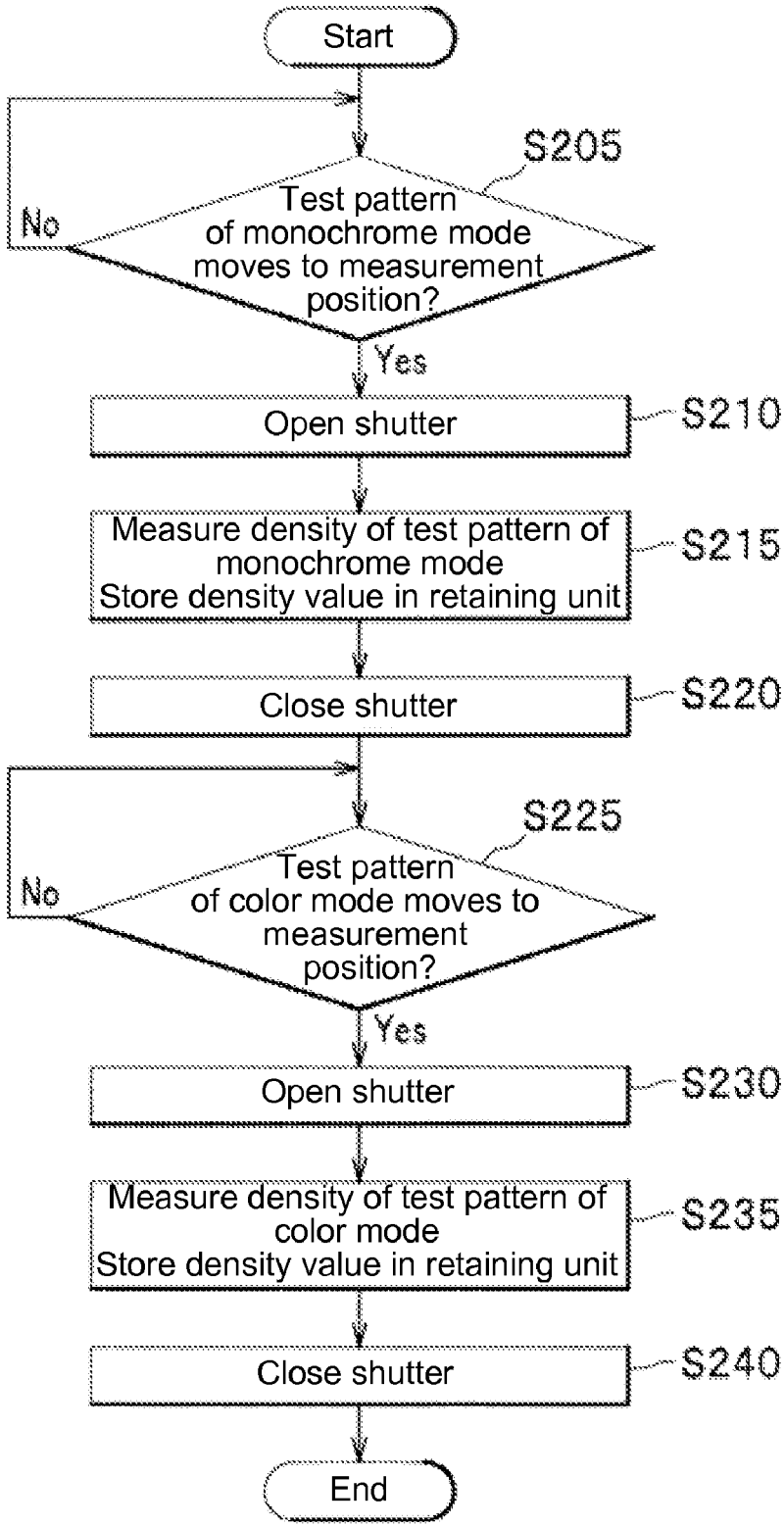
FIG. 7 is a flow chart No. 2 showing the operation of the image forming apparatus according to the first embodiment of the present invention.
Figure 8:
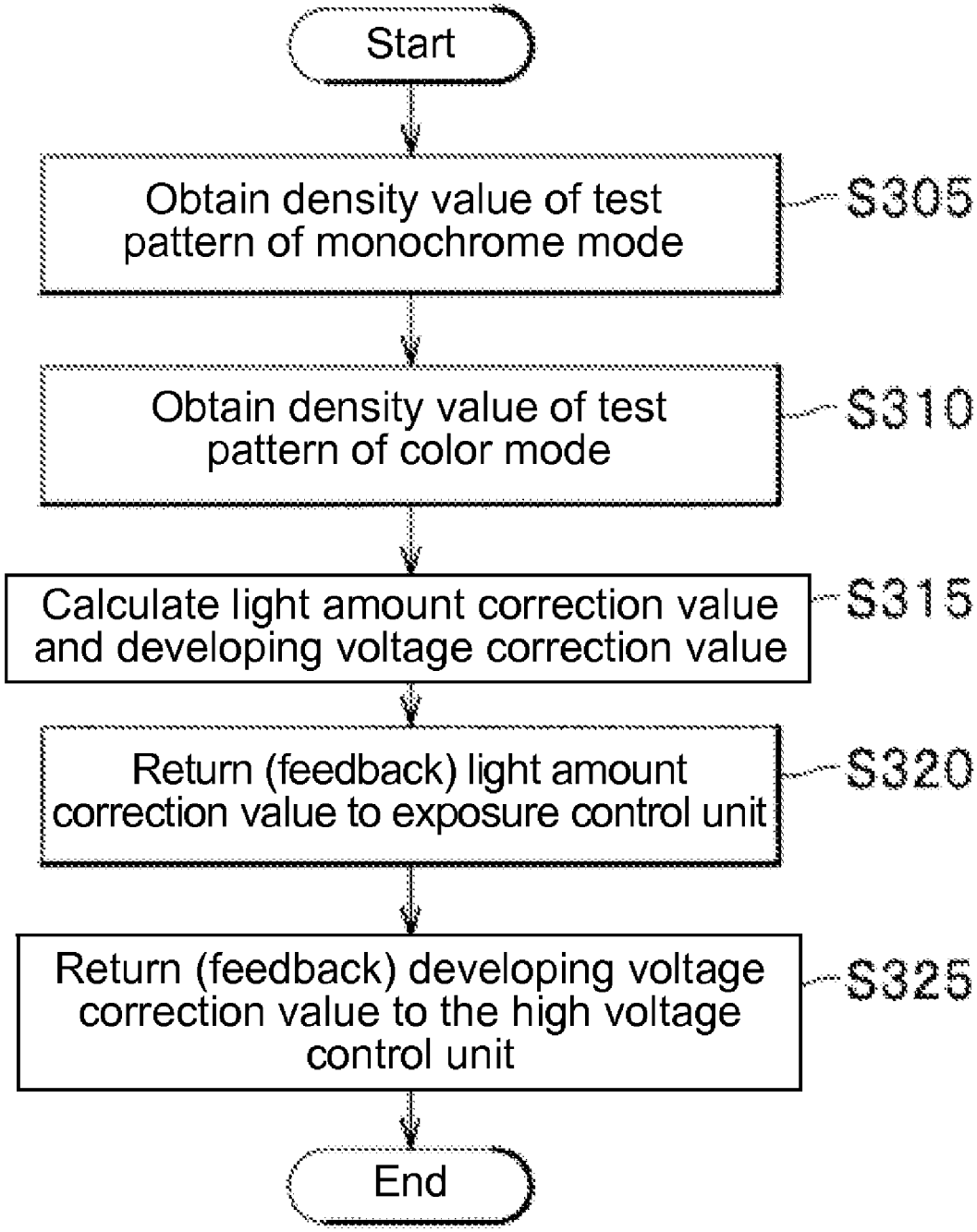
FIG. 8 is a flow chart No. 3 showing the operation of the image forming apparatus according to the first embodiment of the present invention.

An operation of the image forming apparatus 1 will be explained next with reference to FIGS. 6 to 8. FIG. 6 is a flow chart No. 1 showing the operation of the image forming apparatus 1 according to the first embodiment of the present invention. FIG. 7 is a flow chart No. 2 showing the operation of the image forming apparatus 1 according to the first embodiment of the present invention. FIG. 8 is a flow chart No. 3 showing the operation of the image forming apparatus 1 according to the first embodiment of the present invention.

In the embodiment, the image forming apparatus 1 performs an operation according to a time measured with a timer (not shown). Further, a series of operations of the image forming apparatus 1 is regulated through a program stored in advance in a storage unit (not shown) in a freely-readable manner. The image forming apparatus 1 is configured such that information is temporarily stored in the storage unit in a freely-readable manner, and is output to a specific component for performing a process. These features are well-known in the field, and detailed explanations thereof are omitted.

FIG. 6 is the flow chart No. 1 showing the operation of the image forming apparatus 1 for printing the test pattern 301 and the test pattern 302. In this case, it is assumed that the image forming apparatus 1 prints the test pattern 301 in the monochrome mode first, and then prints the test pattern 302 in the color mode. It is noted that the image forming apparatus 1 prints the test pattern 301 and the test pattern 302 when a consumed amount of black developer exceeds a specific amount. When the consumed amount of black developer exceeds the specific amount during the printing operation of a specific job, the image forming apparatus 1 prints the test pattern 301 and the test pattern 302 after the printing operation of the specific job is finished.

As shown in FIG. 6, in step S105, in the image forming apparatus 1, the first image measurement unit 203 of the print control unit 200 (refer to FIG. 3) determines whether only the image forming unit 70K of black is lowered (that is, only the image forming unit 70K of black is situated at the first position, and the image forming units 70Y, 70M, and 70C are situated at the second position) according to the detection value of the detection units 22.

When the first image measurement unit 203 of the print control unit 200 (refer to FIG. 3) determines that only the image forming unit 70K of black is lowered in step S105 (Yes), the process proceeds to step S106. When the first image measurement unit 203 of the print control unit 200 (refer to FIG. 3) determines that only the image forming unit 70K of black is not lowered in step S105 (No), the first image measurement unit 203 sends the control signal for instructing the printing operation of the test pattern 301 to the corresponding functional components, i.e., the exposure control unit 210, the high voltage control unit 220, and the motor control unit 230 (refer to FIG. 3).

When the motor control unit 230 receives the control signal, the motor control unit 230 drives the up-down control motor 235 (refer to FIG. 3) to rotate for a specific amount, so that the slide links 51 of the up-down mechanism 50 (refer to FIG. 2) slide. Accordingly, in step S110, only the image forming unit 70K of black is lowered (situated at the first position), and the image forming units 70Y, 70M, and 70C are lifted (situated at the second position).

When only the image forming unit 70K of black is lowered (situated at the first position), the high voltage control unit 220 (refer to FIG. 3) controls the voltage application unit (not shown) to apply the voltages to the charging roller 7K, the developing roller 8K, and the transfer roller 9K. Further, the exposure control unit 210 (refer to FIG. 3) controls the LED head 23K to emit light. Accordingly, in step S115, the image forming apparatus 1 forms the test pattern 301 (refer to FIG. 4) on the photosensitive drum 6K (refer to FIG. 1), and the test pattern 301 is transferred (printed) to the transfer belt 10.

After the process in step S115 is completed, the second image measurement unit 204 of the print control unit 200 (refer to FIG. 3) sends the control signal for instructing the printing operation of the test pattern 302 in the color mode to the corresponding functional components, i.e., the exposure control unit 210, the high voltage control unit 220, and the motor control unit 230 (refer to FIG. 3).

When the motor control unit 230 receives the control signal, the motor control unit 230 drives the up-down control motor 235 (refer to FIG. 3) to rotate for a specific amount, so that the slide links 51 of the up-down mechanism (refer to FIG. 2) slide. Accordingly, in step S120, all of the image forming units 70K, 70Y, 70M, and 70C are lowered (situated at the first position).

When the image forming units 70K, 70Y, 70M, and 70C are lowered (situated at the first position), the high voltage control unit 220 (refer to FIG. 3) controls the voltage application unit (not shown) to apply the voltages to the charging rollers 7K, 7Y, 7M, and 7C, the developing rollers 8K, 8Y, 8M, and 8C, and the transfer rollers 9K, 9Y, 9M, and 9C. Further, the exposure control unit 210 (refer to FIG. 3) controls the LED heads 23K, 23Y, 23M, and 23C to emit light. Accordingly, in step S125, the image forming apparatus 1 forms the test pattern 302 (refer to FIG. 4) on the photosensitive drums 6K, 6Y, 6M, and 6C (refer to FIG. 1), and the test pattern 302 is transferred (printed) to the transfer belt 10.

After the process in step S125 is completed, the print control unit 200 (refer to FIG. 3) sends the control signal for instructing the idle state to the corresponding functional components, i.e., the exposure control unit 210, the high voltage control unit 220, and the motor control unit 230 (refer to FIG. 3).

When the motor control unit 230 receives the control signal, the motor control unit 230 drives the up-down control motor 235 (refer to FIG. 3) to rotate for a specific amount, so that the slide links 51 of the up-down mechanism (refer to FIG. 2) slide. Accordingly, in step S130, all of the image forming units 70K, 70Y, 70M, and 70C are lifted (situated at the second position). Through the process described above, the image forming apparatus 1 completes the printing operation of the test pattern 301 and the test pattern 302.

In the embodiment, when the image forming apparatus 1 performs the density correction, it is necessary to measure the densities of the test pattern 301 printed in the monochrome mode in step S115 and the test pattern 302 printed in the color mode in step S125. FIG. 7 is the flow chart No. 2 showing the operation of the image forming apparatus 1 for measuring the densities of the test pattern 301 and the test pattern 302.

As shown in FIG. 7, in step S205, the print control unit 200 of the image forming apparatus 1 (refer to FIG. 3) determines whether the test pattern 301 of the monochrome mode moves to a measurement position. In this case, the measurement position corresponds to a position of the density measuring unit 18. When the print control unit 200 of the image forming apparatus 1 (refer to FIG. 3) determines that the test pattern 301 of the monochrome mode does not move to the measurement position (No) in step S205, the print control unit 200 repeats the process in step S205.

In step S210, when the print control unit 200 of the image forming apparatus 1 (refer to FIG. 3) determines that the test pattern 301 of the monochrome mode moves to the measurement position (Yes) in step S205, the print control unit 200 controls the shutter 19 (refer to FIG. 1) to open. In step S215, the print control unit 200 controls the density measuring unit 18 (refer to FIG. 3) to measure the density of the test pattern 301 of the monochrome mode, and obtains the density value thus measured from the density measuring unit 18, thereby retaining (storing) the density value in the retaining unit 205 (refer to FIG. 3). In step S220, the print control unit 200 controls the shutter 19 to close.

After the print control unit 200 controls the shutter 19 to close in step S220, in step S225, the print control unit 200 of the image forming apparatus 1 (refer to FIG. 3) determines whether the test pattern 302 of the color mode moves to the measurement position. When the print control unit 200 of the image forming apparatus 1 (refer to FIG. 3) determines that the test pattern 302 of the color mode does not move to the measurement position (No) in step S225, the print control unit 200 repeats the process in step S225.

In step S230, when the print control unit 200 of the image forming apparatus 1 (refer to FIG. 3) determines that the test pattern 302 of the color mode moves to the measurement position (Yes) in step S225, the print control unit 200 controls the shutter 19 (refer to FIG. 1) to open. In step S235, the print control unit 200 controls the density measuring unit 18 (refer to FIG. 3) to measure the density of the test pattern 302 of the color mode, and obtains the density value thus measured from the density measuring unit 18, thereby retaining (storing) the density value in the retaining unit 205 (refer to FIG. 3). In step S240, the print control unit 200 controls the shutter 19 to close. Through the process described above, the image forming apparatus 1 completes the operation of measuring the densities of the test pattern 301 and the test pattern 302.

In the embodiment, the image forming apparatus 1 compares the density of the test pattern 301 of the monochrome mode with the density of the test pattern 302 of the color mode to calculate the correction value with respect to the density of the low duty image in the common color (black) in the color mode, thereby correcting the density of the common color (black) in the color mode. FIG. 8 is the flow chart No. 3 showing the operation of the image forming apparatus 1 for correcting the density of the common color (black) in the color mode.

As shown in FIG. 8, the density calculation unit 201 of the print control unit 200 of the image forming apparatus 1 (refer to FIG. 3) retrieves the density value of the test pattern 301 of the monochrome mode retained (stored) in the retaining unit 205 in step S215 from the retaining unit 205 (refer to FIG. 3). Accordingly, in step S305, the density calculation unit 201 obtains the density value of the test pattern 301 of the monochrome mode. Further, the density calculation unit 201 of the print control unit 200 of the image forming apparatus 1 (refer to FIG. 3) retrieves the density value of the test pattern 302 of the color mode retained (stored) in the retaining unit 205 in step S235 from the retaining unit 205 (refer to FIG. 3). Accordingly, in step S310, the density calculation unit 201 obtains the density value of the test pattern 302 of the color mode.

After the density calculation unit 201 obtains the density value of the test pattern 302 of the color mode in step S310, in step S315, the density calculation unit 201 calculates the light amount correction value and the developing voltage correction value. When the density calculation unit 201 calculates the light amount correction value and the developing voltage correction value, the density calculation unit 201 substitutes the density value of the test pattern 301 in the monochrome mode and the density value of the test pattern 302 in the color mode into specific equations (equations (1) and (2), described later). The method of calculating the light amount correction value and the developing voltage correction value will be explained in more detail later.

After the density calculation unit 201 calculates the light amount correction value and the developing voltage correction value in step S315, in step S320, the density correction unit 202 of the print control unit 200 of the image forming apparatus 1 (refer to FIG. 3) returns (feedback) the light amount correction value to the exposure control unit 210 (refer to FIG. 3). Accordingly, the exposure control unit 210 corrects the exposure light energy of the exposure units (the LED heads 23K, 23Y, 23M, and 23C) for the next printing operation according to the light amount correction value thus returned (feedback).

Similarly, in step S325, the density correction unit 202 of the print control unit 200 of the image forming apparatus 1 (refer to FIG. 3) returns (feedback) the developing voltage correction value to the high voltage control unit 220 (refer to FIG. 3). Accordingly, the high voltage control unit 220 corrects the developing energy (the developing voltage) to be applied to the developing roller 8K of the image forming unit 70K of black according to the developing voltage correction value thus returned (feedback). Through the process described above, the density of the common color (black) in the color mode is corrected, and the image forming apparatus 1 completes the operation of correcting the density of the common color (black) in the color mode.

The method of calculating the light amount correction value and the developing voltage correction value will be explained in more detail next. As described above, in the embodiment, when the density calculation unit 201 calculates the light amount correction value and the developing voltage correction value, the density calculation unit 201 substitutes the density value of the test pattern 301 in the monochrome mode and the density value of the test pattern 302 in the color mode into the equations (1) and (2).

It is noted that the equations (1) and (2) are modified from conventional calculation equations (equations (3) and (4), described later) for the light amount correction value and the developing voltage correction value disclosed in Patent Reference cited in the section "BACKGROUND OF THE INVENTION AND RELATED ART STATEMENT".

The equation (1) is expressed as follows:

$$\text{Light amount correction value}=[\{\text{high duty color mode density detected value}\times(\text{one-by-one monochrome mode density detected value}/\text{high duty monochrome mode density detected value})-\text{one-by-one color mode density detected value}\}/K1+\{\text{high duty color mode density detected value}\times(\text{middle duty monochrome mode density detected value}/\text{high duty monochrome mode density detected value})-\text{middle duty color mode density detected value}\}/K2]/2 \quad (1)$$

The equation (2) is expressed as follows:

$$\text{Developing voltage correction value}=[\{\text{one-by-one monochrome mode density detected value}-(\text{one-by-one color mode density detected value}+\text{light amount variance amount}\times K1)\}/K3+\{\text{middle duty monochrome mode density detected value}-(\text{middle duty color mode density detected value}+\text{light amount variance amount}\times K2)\}/K4+(\text{high duty monochrome mode density detected value}-\text{high duty color mode density detected value})/K5]/3 \quad (2)$$

In the equations (1) and (2), the coefficient K1 is a one-by-one density variance amount per variance unit of the static latent image forming unit (the light amount). The coefficient K2 is a middle duty density variance amount per variance unit of the static latent image forming unit (the light amount). The coefficient K3 is a one-by-one density variance amount per variance unit of the developing voltage. The coefficient K4 is a middle density variance amount per variance unit of the developing voltage. The coefficient K5 is a high density variance amount per variance unit of the developing voltage.

As described above, the duty represents the print density, and is defined as the sum of the average densities of the colors K, Y, M, and C at a specific location in a specific range. The middle duty density is in a range of 30% to 80%, and the high duty density is greater than 60%. The middle duty density is smaller than the high duty density and is greater than the one-by-one density (the one-by-one density<the middle duty density 21 the high duty density).

In the embodiment, with the correction value calculation equation (1), it is possible to average the light amount correction values for correcting the light amount (the exposure light energy) in good balance regardless of darkness of the printed image.

More specifically, in the equation (1), a K1 dividing calculation portion is defined as "{high duty color mode density detected value×(one-by-one monochrome mode density detected value/high duty monochrome mode density detected value)−one-by-one color mode density detected value}/K1", and has a weighing coefficient of one. Similarly, a K2 dividing calculation portion is defined as "{high duty color mode density detected value×(middle duty monochrome mode density detected value/high duty monochrome mode density detected value)−middle duty color mode density detected value}/K2", and has a weighing coefficient of one. A sum of the K1 dividing calculation portion and the K2 dividing calculation portion is calculated, and is divided by two, i.e., a sum of the weighing coefficients, thereby averaging the light amount correction values.

In the embodiment, with the equation (2), it is possible to average the developing voltage correction values for correcting the developing voltage (the developing energy) in good balance regardless of darkness of the printed image.

More specifically, in the equation (2), a K3 dividing calculation portion is defined as "{one-by-one monochrome mode density detected value−(one-by-one color mode density detected value+light amount variance amount×K1)}/K3", and has a weighing coefficient of one. Similarly, a K4 dividing calculation portion is defined as "{middle duty monochrome mode density detected value−(middle duty color mode density detected value+light amount variance amount×K2)}/K4", and has a weighing coefficient of one. Similarly, a K5 dividing calculation portion is defined as "(high duty monochrome mode density detected value−high duty color mode density detected value)/K5", and has a weighing coefficient of one. A sum of the K3 dividing calculation portion, the K4 dividing calculation portion, and the K5 dividing calculation portion is calculated, and is divided by three, i.e., a sum of the weighing coefficients, thereby averaging the developing voltage correction values.

As described above, in the embodiment, the developing voltage applied to the developing roller 8K of the image forming unit 70K of black is explained as the subject of the developing energy correction. Alternatively, other than the developing voltage applied to the developing roller 8K of the image forming unit 70K of black, the supply voltage applied to a supply roller of the image forming unit 70K of black, the charging voltage applied to the charging roller 7K of the image forming unit 70K of black, or the transfer voltage applied to the transfer roller 9K of the image forming unit 70K of black may be the subject of the developing energy correction.

As described above, the equations (1) and (2) are modified from the conventional calculation equations, i.e., the equations (3) and (4), for the light amount correction value and the developing voltage correction value disclosed in Patent Reference cited in the section "BACKGROUND OF THE INVENTION AND RELATED ART STATEMENT". The equation (3) is expressed as follows:

$$\text{Light amount correction value}=[\{\text{high duty detected value}\times(\text{low duty target value/high duty target value})-\text{low duty detected value}\}/K1+\{\text{high duty detected value}\times(\text{middle duty target value/high duty target value})-\text{middle duty detected value}\}/K2]/2 \quad (3)$$

The equation (4) is expressed as follows:

$$\text{Developing voltage correction value}=[\{\text{low duty target value}-(\text{low duty detected value}-\text{light amount variance amount}\times K1)\}/K3+\{\text{middle duty target value}-(\text{middle duty detected value}-\text{light amount variance amount}\times K2)\}/K4+(\text{high duty target value}-\text{high duty detected value})/K5]/3 \quad (4)$$

In the equations (3) and (4), the coefficient K1 is a low density variance amount per variance unit of the light amount. The coefficient K2 is a middle duty density variance amount per variance unit of the light amount. The coefficient K3 is a low density variance amount per variance unit of the developing voltage. The coefficient K4 is a middle density variance amount per variance unit of the developing voltage. The coefficient K5 is a high density variance amount per variance unit of the developing voltage.

As described above, the duty represents the print density, and is defined as the sum of the average densities of the colors K, Y, M, and C at a specific location in a specific range. The middle duty density is in a range of 30% to 80%, and the high duty density is greater than 60%.

As opposed to the conventional calculation equations, i.e., the equations (3) and (4), for the light amount correction value and the developing voltage correction value disclosed in Patent Reference, in the embodiment, the equations (1) and (2) for calculating the light amount correction value and the developing voltage correction value have the following differences. First, the low duty detected value in the conventional calculation equations is replaced with the density of the test pattern. Second, the target value in the conventional calculation equations is replaced with the color mode density detected value, and the detected value in the conventional calculation equations is replaced with the monochrome mode density detected value. Accordingly, it is possible to convert the black density value detected in the color mode to the black density value detected in the monochrome mode. As a result, the equations (1) and (2) can be used for correcting the density of the common color (black).

As described above, in the embodiment, when the color balance is adjusted in the image forming apparatus 1, the test pattern 301 and the test pattern 302 modified with the specific improvement are printed on the transfer belt 10, thereby measuring the densities of the test pattern 301 and the test pattern 302. Then, it is configured to correct the density of the low duty image of the common color (black) in the color mode according to the density values of the test pattern 301 and the test pattern 302. Accordingly, it is possible to prevent the density of the image in the common color from lowering in the color mode. As a result, in the image forming apparatus 1, it is possible to form the image in the common color (black) with a same density when the image forming apparatus 1 performs the printing operation in the monochrome mode and the color mode.

Second Embodiment

A second embodiment of the present invention will be explained next.

As described above, in the first embodiment, the image forming apparatus 1 calculates the light amount correction value and the developing voltage correction value according to the most recent density detected value in the monochrome mode and the most recent density detected value in the common color (black) in the monochrome mode. Then, the light amount correction value and the developing voltage correction value thus calculated are returned (feedback), and the image forming apparatus 1 forms the image, thereby correcting the density of the low duty image in the common color in the color mode.

On the other hand, in the second embodiment, an image forming apparatus 1*a* calculates a second light amount correction value and a second developing voltage correction value according to the most recent density detected value in the monochrome mode and an initial density of the test pattern as the light amount correction value and the developing voltage correction value calculated according to the most recent density detected value in the monochrome mode and the most recent density detected value in the common color (black) in the color mode.

Further, in the second embodiment, the image forming apparatus 1*a* adds the second light amount correction value to the light amount correction value to calculate a modified light amount correction value. Further, the image forming apparatus 1*a* adds the second developing voltage correction value to the developing voltage correction value to calculate a modified developing voltage correction value. Then, the modified light amount correction value and the modified developing voltage correction value thus calculated are returned (feedback), and the image forming apparatus 1*a* forms an image, thereby correcting a density in the monochrome mode and a density in the color mode.

Figure 9:
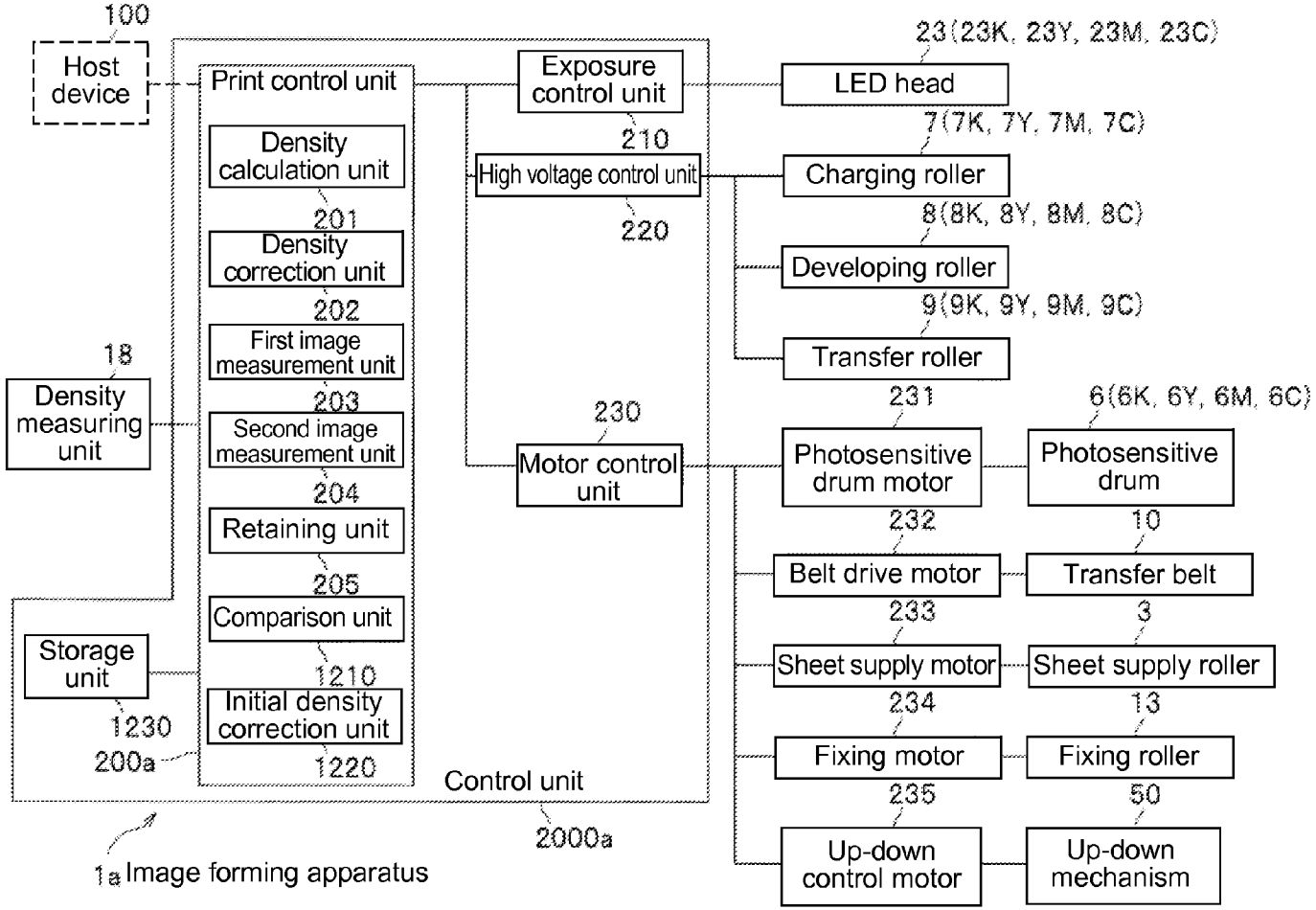
FIG. 9 is a block diagram showing a functional system of an image forming apparatus according to a second embodiment of the present invention.

A functional system of the image forming apparatus 1*a* will be explained with reference to FIG. 9. FIG. 9 is a block diagram showing the functional system of the image forming apparatus 1*a* according to the second embodiment of the present invention. In the following description, a configuration of the image forming apparatus 1*a* in the second embodiment different from that of the image forming apparatus 1 in the first embodiment will be mainly explained. Explanations of components of the image forming apparatus 1*a* similar to those of the image forming apparatus 1 (refer to FIG. 3) are omitted.

As shown in FIG. 9, the image forming apparatus 1*a* includes a control unit 2000*a* for controlling an entire operation of the image forming apparatus 1*a*. The control unit 2000*a* includes a print control unit 200*a*, the exposure control unit 210, the high voltage control unit 220, and the motor control unit 230. Different from the print control unit 200 of the image forming apparatus 1, the print control unit 200*a* includes a comparison unit 1210, an initial density correction unit 1220, and a storage unit 1230.

In the embodiment, the comparison unit 1210 is provided for comparing an initial density of the test pattern stored in the storage unit 1230 (that is, a density detected value in the monochrome mode when the image forming apparatus 1*a* is delivered) with a most recent density detected value in the monochrome mode and a most recent density detected value in the common color (black) in the color mode stored in the retaining unit 205. Further, the comparison unit 1210 is provided for sending a density difference relative to the initial density of the test pattern (that is, a difference between the initial density of the test pattern and the most recent density detected value in the monochrome mode and the most recent density detected value in the common color (black) in the color mode) to the density calculation unit 201.

In the embodiment, the initial density correction unit 1220 is provided for sending the light amount correction value to the exposure control unit 210 and the developing voltage correction value to the high voltage control unit 220 according to a control value calculated with the density calculation unit 201.

In the embodiment, the storage unit 1230 is provided for permanently storing the initial density of the test pattern (that is, the density detected value in the monochrome mode when the image forming apparatus 1*a* is delivered). Further, the storage unit 1230 is formed of a non-volatile storage device such as an HDD (Hard Disc Drive) or an ROM (Read Only Memory), so that contents of the storage unit 1230 are not deleted when the image forming apparatus 1*a* is turned off.

Figure 10:
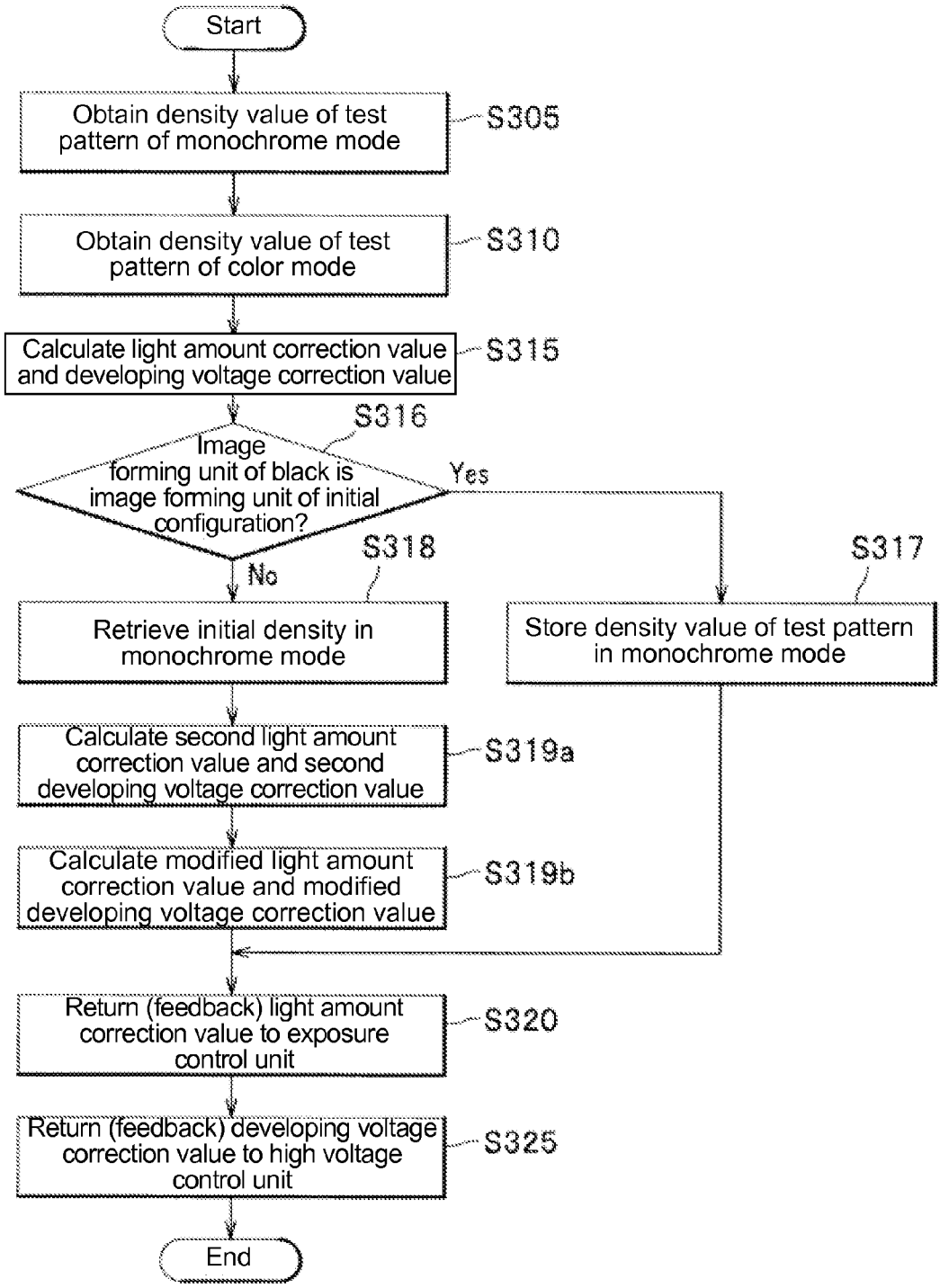
FIG. 10 is a flow chart showing an operation of the image forming apparatus according to the second embodiment of the present invention.

An operation of the image forming apparatus 1*a* will be explained next with reference to FIG. 10. FIG. 10 is a flow chart showing the operation of the image forming apparatus 1*a* according to the second embodiment of the present invention. In the following description, a process of the image forming apparatus 1*a* in the second embodiment different from that of the image forming apparatus 1 in the first embodiment will be mainly explained. Explanations of processes of the image forming apparatus 1*a* similar to those of the image forming apparatus 1 (refer to FIGS. 6 to 8) are omitted.

As described above, in the first embodiment, the image forming apparatus 1 calculates the light amount correction value and the developing voltage correction value according to the most recent density detected value in the monochrome mode and the most recent density detected value in the common color (black) in the monochrome mode. Then, the light amount correction value and the developing voltage correction value thus calculated are returned (feedback), and the image forming apparatus 1 forms the image, thereby correcting the density of the low duty image in the common color in the color mode.

On the other hand, in the second embodiment, the image forming apparatus 1*a* calculates the second light amount correction value and the second developing voltage correction value according to the most recent density detected value in the monochrome mode and the initial density of the test pattern as the light amount correction value and the developing voltage correction value calculated according to the most recent density detected value in the monochrome mode and the most recent density detected value in the common color (black) in the color mode.

Further, in the second embodiment, the image forming apparatus 1*a* adds the second light amount correction value to the light amount correction value to calculate the modified light amount correction value. Further, the image forming apparatus 1*a* adds the second developing voltage correction value to the developing voltage correction value to calculate the modified developing voltage correction value. Then, the modified light amount correction value and the modified developing voltage correction value thus calculated are returned (feedback), and the image forming apparatus 1*a* forms the image, thereby correcting the density in the monochrome mode and the density in the color mode.

In the embodiment, the most recent density detected value in the monochrome mode and the most recent density detected value in the common color (black) in the color mode are measured in step S215 and step S235 shown in FIG. 7. Then, the most recent density detected value in the monochrome mode and the most recent density detected value in the common color (black) in the color mode are stored in the retaining unit 205. Further, the initial density of the test pattern (that is, the density detected value in the monochrome mode when the image forming apparatus 1*a* is delivered) is stored in the storage unit 1230 (refer to FIG. 9).

As shown in FIG. 10, as opposed to the operation of the image forming apparatus 1 shown in FIG. 8, the operation of the image forming apparatus 1*a* includes the process from step S316 to step S319*b* between the process in step S315 and the process in step S320. In the following description, the process from step S316 to step S319*b* will be mainly explained. It is noted that the light amount correction value of the LED heads 23K, 23Y, 23M, and 23C and the developing voltage correction value are calculated in step S315. The light amount correction value and the developing voltage correction value are referred to as a first light amount correction value and a first developing voltage correction value.

After the process in step S315, in step S316, the comparison unit 1210 of the image forming apparatus 1*a* (refer to FIG. 9) determines whether the image forming unit 70K of black is the image forming unit 70K of the initial configuration (when the image forming apparatus 1*a* is delivered). More specifically, when the image forming unit 70K is replaced, the print control unit 200*a* stores information indicating the replacement in the storage unit 1230 (or a storage unit, not shown). Accordingly, the comparison unit 1210 refers to the information to determine whether the image forming unit 70K of black is the image forming unit 70K of the initial configuration.

When the comparison unit 1210 determines that the image forming unit 70K of black is the image forming unit 70K of the initial configuration in step S316 (Yes), in step S317, the density calculation unit 201 (refer to FIG. 9) stores the density value of the test pattern 301 in the monochrome mode obtained in step S305 in the storage unit 1230 as the initial density in the monochrome mode. When the density calculation unit 201 already stores the initial density in the monochrome mode in the storage unit 1230, the density calculation unit 201 overwrites the density value of the test pattern 301 in the monochrome mode obtained in step S305.

Afterward, the process proceeds to step S320, in which the light amount correction value is returned (feedback) to the exposure control unit 210. More specifically, in step S320, the light amount correction value calculated in step S315 is returned (feedback) to the exposure control unit 210. In step S325, the developing voltage correction value calculated in step S315 is returned (feedback) to the high voltage control unit 220.

When the comparison unit 1210 determines that the image forming unit 70K of black is not the image forming unit 70K of the initial configuration in step S316 (No), in step S318, the initial density correction unit 1220 retrieves the initial density in the monochrome mode from the storage unit 1230.

After the process in step S318, in step S319*a*, the initial density correction unit 1220 calculates the second light amount correction value and the second developing voltage correction value. More specifically, the initial density correction unit 1220 substitutes the most recent density value of the test pattern 301 in the monochrome mode (referred to as a monochrome mode density detected value) and the initial density value of the test pattern 301 (referred to as an initial monochrome mode density detected value) into the equations (5) and (6).

The equation (5) is expressed as follows:

$$\text{Second light amount correction value}=[\{\text{high duty monochrome mode density detected value}\times(\text{one-by-one initial monochrome mode density detected value/high duty initial monochrome mode density detected value})-\text{one-by-one monochrome mode density detected value}\}/K1+\{\text{high duty monochrome mode density detected value}\times(\text{middle duty initial monochrome mode density detected value/high duty initial monochrome mode density detected value})-\text{middle duty monochrome mode density detected value}\}/K2]/2 \quad (5)$$

The equation (6) is expressed as follows:

$$\text{Second developing voltage correction value}=[\{\text{one-by-one initial monochrome mode density detected value}-(\text{one-by-one monochrome mode density detected value}+\text{light amount variance amount}\times K1)\}/K3+\{\text{middle duty initial monochrome mode density detected value}-(\text{middle duty monochrome mode density detected value}+\text{light amount variance amount}\times K2)\}/K4+(\text{high duty initial monochrome mode density detected value}-\text{high duty monochrome mode density detected value})/K5]/3 \quad (6)$$

With the equations (5) and (6), it is possible to calculate a shift value caused by the difference between the monochrome mode density detected value and the initial monochrome mode density detected value relative to the first light amount correction value and the first developing voltage correction value calculated with the equations (1) and (2). In the equations (5) and (6), the color mode density detected value in the equations (1) and (2) is replaced with the monochrome mode density detected value. Further, the monochrome mode density detected value in the equations (1) and (2) is replaced with the initial monochrome mode density detected value.

In step S319*b*, the initial density correction unit 1220 adds the second light amount correction value and the second developing voltage correction value to the first light amount correction value and the first developing voltage correction value calculated in step S315, thereby calculating the modified light amount correction value and the modified developing voltage correction value, respectively. Then, the initial density correction unit 1220 sends the modified light amount correction value and the modified developing voltage correction value to the density correction unit 202 (refer to FIG. 9).

After the process in step S317 or the process in step S319*b*, in step S320, the density correction unit 202 of the print control unit 200 returns (feedback) the light amount correction value to the exposure control unit 210 (refer to FIG. 3). More specifically, when it is after the process in step S317, the density correction unit 202 returns (feedback) the first light amount correction value as the light amount correction value to the exposure control unit 210. When it is after the process in step S319*b*, the density correction unit 202 returns (feedback) the modified light amount correction value as the light amount correction value to the exposure control unit 210. Accordingly, the exposure control unit 210 corrects the exposure light energy of the exposure units (the LED heads 23K, 23Y, 23M, and 23C) for the next printing operation according to the light amount correction value thus returned (feedback).

Similarly, after the process in step S320, in step S325, the density correction unit 202 of the print control unit 200 of the image forming apparatus 1 (refer to FIG. 3) returns (feedback) the developing voltage correction value to the high voltage control unit 220 (refer to FIG. 3). More specifically, when it is after the process in step S317, the density correction unit 202 returns (feedback) the first developing voltage correction value as the developing voltage correction value to the high voltage control unit 220. When it is after the process in step S319*b*, the density correction unit 202 returns (feedback) the modified developing voltage correction value as the developing voltage correction value to the high voltage control unit 220. Accordingly, the high voltage control unit 220 corrects the developing energy (the developing voltage) to be applied to the developing roller 8K of the image forming unit 70K of black according to the developing voltage correction value thus returned (feedback). Through the process described above, the density of the common color (black) in the color mode is corrected, and the image forming apparatus 1 completes the operation of correcting the density of the common color (black) in the color mode.

As described above, in the image forming apparatus 1*a* in the second embodiment, similar to the image forming apparatus 1 in the first embodiment, it is possible to form the image in the common color (black) with a same density when the image forming apparatus 1 performs the printing operation in the monochrome mode and the color mode.

Further, in the image forming apparatus 1*a*, the initial density of the test pattern (the density detected value in the monochrome mode when the image forming apparatus 1*a* is delivered) is stored in the storage unit 1230, so that the light amount correction value and the developing voltage correction value are returned (feedback). Accordingly, regardless of an aging change of the image forming units 70, it is possible to make the density detected value in the monochrome mode and the density detected value in the common color in the color mode in the next printing operation equal to the initial density of the test pattern.

It is noted that the present invention is not limited to the embodiments described above, and may be modified in various ways within the scope of the present invention. For example, in the embodiments, the image forming apparatus of the tandem type and the direct printing type is explained. The present invention is not limited to the image forming apparatus of this type, and may be applicable to an image forming apparatus of an intermediate transfer type.

Further, in the embodiments described above, the up-down mechanism 50 (the separation contacting mechanism) is provided for moving all of the image forming units 70 collectively, and may be configured to move separately each of the image forming units 70.

Further, in the embodiments described above, when the image forming apparatus 1 or the image forming apparatus 1*a* performs the printing operation in the monochrome mode, developer in black is used. In the present invention, when the image forming apparatus 1 or the image forming apparatus 1*a* performs the printing operation in the monochrome mode using developer other than black, it is possible to correct the energy amount of the image forming units 70 in other colors.

Further, the present invention may be applicable to, in addition to the printer, an image forming apparatus such as a facsimile, a copier, and a multi function peripheral or product (MFP) having three functions of the printer, the facsimile, and the copier as far as the image forming apparatus has a plurality of the image forming units 70.

The disclosure of Japanese Patent Application No. 2009-189644, filed on Aug. 19, 2009, is incorporated in the application.

While the invention has been explained with reference to the specific embodiments of the invention, the explanation is illustrative and the invention is limited only by the appended claims.

What is claimed is:

1. An image forming apparatus comprising:

a first image forming unit for forming a first developer image using first developer;

a second image forming unit for forming a second developer image using second developer;

a transfer unit disposed to contact with at least one of the first image forming unit and the second image forming unit for transferring at least one of the first developer image and the second developer image;

a separation contacting unit for moving at least one of the first image forming unit and the second image forming unit to a first position contacting with the transfer unit and to a second position away from the transfer unit;

a density measurement unit for measuring a first image density of the first developer image when the first image forming unit is situated at the first position and the second image forming unit is situated at the second position, and for measuring a second image density of the first developer image when the first image forming unit and the second image forming unit are situated at the first position; and a control unit for controlling the first image forming unit, the second image forming unit, the density measurement unit, and the separation contacting unit, said control unit including a density calculation unit for calculating a difference between the first image density and the second image density and a density correction unit for correcting a density of the first developer image according to the difference.

2. The image forming apparatus according to claim 1, wherein said first image forming unit is arranged to form the first developer image using the first developer in a monochrome mode and a color mode, and said second image forming unit is arranged to form the second developer image using the second developer only in the color mode.

3. The image forming apparatus according to claim 1, wherein said density correction unit is arranged to adjust an energy amount associated with an attached amount of the first developer.

4. The image forming apparatus according to claim 1, wherein said density correction unit is arranged to adjust an exposure light energy defined with a light amount upon exposure.

5. The image forming apparatus according to claim 1, wherein said density correction unit is arranged to adjust a developing energy amount defined with at least one of a developing voltage, a supply voltage, and a charging voltage.

6. The image forming apparatus according to claim 1, wherein said control unit includes a storage unit for storing an initial density of the first developer image; a comparison unit for comparing the initial density with a most recent density of the first developer image; and an initial density correction unit for correcting the density of the first developer image according to a difference between the initial density and the most recent density.

7. The image forming apparatus according to claim 6, wherein said initial density correction unit is arranged to calculate a second light amount correction value according to the following equation:

Second light amount correction value=[{high duty monochrome mode density detected value×(one-by-one initial monochrome mode density detected value/high duty initial monochrome mode density detected value)−one-by-one monochrome mode density detected value}/$K1$+{high duty monochrome mode density detected value×(middle duty initial monochrome mode density detected value/high duty initial monochrome mode density detected value)−middle duty monochrome mode density detected value}/$K2$]/2 where the coefficient K1 is a one-by-one density variance amount per variance unit of a light amount; and the coefficient K2 is a middle duty density variance amount per variance unit of the light amount.

8. The image forming apparatus according to claim 6, where said initial density correction unit is arranged to calculate a second developing voltage correction value according to the following equation:

Second developing voltage correction value=[{one-by-one initial monochrome mode density detected value−(one-by-one monochrome mode density detected value+light amount variance amount×$K1$)}/$K3$+{middle duty initial monochrome mode density detected value−(middle duty monochrome mode density detected value+light amount variance amount×$K2$)}/$K4$+(high duty initial monochrome mode density detected value−high duty monochrome mode density detected value)/$K5$]/3 where the coefficient K1 is a one-by-one density variance amount per variance unit of a light amount; the coefficient K2 is a middle duty density variance amount per variance unit of the light amount; the coefficient K3 is a one-by-one density variance amount per variance unit of a developing voltage; the coefficient K4 is a middle density variance amount per variance unit of the developing voltage; and the coefficient K5 is a high density variance amount per variance unit of the developing voltage.

9. The image forming apparatus according to claim 1, wherein said density calculation unit is arranged to calculate a first light amount correction value according to the following equation:

First light amount correction value=[{high duty color mode density detected value×(one-by-one monochrome mode density detected value/high duty monochrome mode density detected value)−one-by-one color mode density detected value}/$K1$+{high duty color mode density detected value×(middle duty monochrome mode density detected value/high duty monochrome mode density detected value)−middle duty color mode density detected value}/$K2$]/2 where the coefficient K1 is a one-by-one density variance amount per variance unit of a light amount; and the coefficient K2 is a middle duty density variance amount per variance unit of the light amount.

10. The image forming apparatus according to claim 1, wherein said density calculation unit is arranged to calculate a first developing voltage correction value according to the following equation:

First developing voltage correction value=[{one-by-one monochrome mode density detected value=(one-by-one color mode density detected value+light amount variance amount×$K1$)}/$K3$+{middle duty monochrome mode density detected value−(middle duty color mode density detected value+light amount variance amount×$K2$)}/$K4$+(high duty monochrome mode density detected value−high duty color mode density detected value)}/$K5$]/3 where the coefficient K1 is a one-by-one density variance amount per variance unit of a light amount; the coefficient K2 is a middle duty density variance amount per variance unit of the light amount; the coefficient K3 is a one-by-one density variance amount per variance unit of a developing voltage; the coefficient K4 is a middle density variance amount per variance unit of the developing voltage; and the coefficient K5 is a high density variance amount per variance unit of the developing voltage.

* * * * *